US007980205B2

(12) United States Patent
Sato et al.

(10) Patent No.: US 7,980,205 B2
(45) Date of Patent: Jul. 19, 2011

(54) AIR-COOLED ENGINE

(75) Inventors: Yoshikazu Sato, Wako (JP); Akihisa Shinoda, Wako (JP); Kazuhisa Ogawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 645 days.

(21) Appl. No.: 11/993,490

(22) PCT Filed: Jun. 16, 2006

(86) PCT No.: PCT/JP2006/312563

§ 371 (c)(1),
(2), (4) Date: Dec. 21, 2007

(87) PCT Pub. No.: WO2006/137505

PCT Pub. Date: Dec. 28, 2006

(65) Prior Publication Data

US 2010/0031903 A1 Feb. 11, 2010

(30) Foreign Application Priority Data

Jun. 23, 2005 (JP) ..... 2005-182813
Jun. 23, 2005 (JP) ..... 2005-183166

(51) Int. Cl.
*F01P 1/00* (2006.01)
*F02B 75/22* (2006.01)
*F01L 1/02* (2006.01)

(52) U.S. Cl. ..... 123/41.56; 123/41.7; 123/90.31; 123/193.5; 123/195 R

(58) Field of Classification Search ..... 123/41.56–41.7, 123/90.31, 193.5, 195 R
See application file for complete search history.

(56) References Cited

U.S. PATENT DOCUMENTS 3,669,203 A 6/1972 Honda

FOREIGN PATENT DOCUMENTS

| | | | |
|---|---|---|---|
| DE | 893 705 | C | 10/1953 |
| EP | 0 440 401 | A1 | 8/1991 |
| GB | 814 537 | A | 6/1959 |
| JP | 58-19293 | Y2 | 4/1983 |
| JP | 59-49748 | U | 4/1984 |
| JP | 1-163414 | A | 6/1989 |
| JP | 2-275021 | A | 11/1990 |
| JP | 6-346733 | A | 12/1994 |
| JP | 2001-140643 | A | 5/2001 |
| JP | 2002-47934 | A | 2/2002 |

OTHER PUBLICATIONS

Japanese Office Action dated Jan. 7, 2010, issued in corresponding Japanese Patent Application No. P2005-182813.
Japanese Office Action dated Jan. 7, 2010, issued in corresponding Japanese Patent Application No. P2005-183166.
International Search Report of PCT/JP2006/312563, date of mailing Dec. 14, 2006.

*Primary Examiner* — Noah Kamen
(74) *Attorney, Agent, or Firm* — Westerman, Hattori, Daniels & Adrian, LLP

(57) ABSTRACT

An air-cooled engine (10) is cooled by cooling air (Wi). The air-cooled engine (10) includes a cylinder block (33) and a cylinder head (28). The cylinder block (33) has cylinder cooling through-ducts (101, 102) capable of transmitting cooling air (Wi), on the periphery of a cylinder (26). The cylinder head (28) has a head-cooling through-duct (104) capable of transmitting cooling air (Wi). The cylinder-cooling ducts (101, 102) and the head-cooling duct (104) extend in a direction perpendicular to the axial line (109) of the cylinder (26), and are communicated with each other by means of communication channels (105, 105).

7 Claims, 20 Drawing Sheets

AIR-COOLED ENGINE

TECHNICAL FIELD

The present invention relates to an air-cooled engine that is cooled by cooling air.

BACKGROUND ART

Air-cooled engines are forcefully cooled by cooling air sent to a cylinder head and a cylinder block from a cooling fan that is driven by a crankshaft. This type of air-cooled engine is disclosed in Japanese Laid-Open Patent Application No. 2-275021 and Japanese Examined Utility Model Application No. 58-19293.

In the air-cooled engine disclosed in Japanese Laid-Open Patent Application No. 2-275021, an intake valve and an exhaust valve are opened and closed as a result of a camshaft being rotated by a crankshaft via a power transmission mechanism. In this air-cooled engine, the combustion chamber in the cylinder head and the cylinder in the cylinder block are cooled by cooling air sent from the cooling fan to the cylinder head and the cylinder block. In order to improve the efficiency of cooling with this cooling air, it is preferable that the cooling air be conducted to the vicinity of the combustion chamber and the cylinder.

However, the power transmission mechanism is disposed on the side of the cylinder head and on the side of the cylinder block. Therefore, a compartment for accommodating the power transmission mechanism is disposed in the vicinity of the combustion chamber and the cylinder. This compartment is an obstacle to the cooling air being conducted to the vicinity of the combustion chamber and the cylinder.

In order to resolve these problems, in the air-cooled engine in Japanese Laid-Open Patent Application No. 2-275021, the effects of cooling the cylinder are improved by providing part of the compartment with an air duct for allowing the passage of cooling air.

The need has also increased for techniques whereby cooling air can be more actively conducted to the vicinity of the combustion chamber and the cylinder to further improve the effects of cooling the combustion chamber and the cylinder.

The air-cooled engine disclosed in Japanese Examined Utility Model Application No. 58-19293 is an inclined-cylinder engine having a base on the bottom of the crank case, and also having a cylinder block and cylinder inclined to the side of the crank case. The air-cooled engine can be mounted on any other arbitrary member by using bolts inserted through mounting holes in the base.

Also, the outer periphery of the cylinder block has a plurality of cooling fins extending in a direction perpendicular to the axial line of the cylinder. In this air-cooled engine, the cylinder can be cooled by the flow of cooling air among the plurality of cooling fins.

The casing for the air-cooled engine is often a cast article wherein the crank case, the base, and the cylinder block are integrated in order to reduce manufacturing costs. When the casing is manufactured by casting, the metal mold is opened along the cooling fins after the molten metal in the cavity of the metal mold has solidified. However, since the cylinder block and cooling fins are inclined in relation to the base, the direction in which the metal mold opens is different from the orientation of the mounting holes of the base. When the casing is being cast, the mounting holes cannot be formed simultaneously. After the casing is cast, the mounting holes must be mechanically worked in. This places a limit on improving the productivity of the casing.

One method for solving these problems is to provide the metal mold with a separate sliding die, and to form mounting holes by using this sliding die. This method allows the mounting holes to be formed at the same time as the casing is being cast. However, the structure of the metal mold becomes complicated with this method because a sliding die is provided to the metal mold.

In view of this, the need has arisen for techniques whereby the mounting holes can be formed at the same time that the casing is cast and whereby the configuration of the metal mold can be simplified.

DISCLOSURE OF THE INVENTION

The first embodiment of the present invention provides an air-cooled engine that is cooled by cooling air, comprising a cylinder block that comprises a cylinder having a reciprocating piston, and a cylinder head provided to a distal end of the cylinder block; wherein the cylinder block comprises at least one cylinder-cooling through-duct capable of transmitting the cooling air, on the periphery of the cylinder; the cylinder head comprises at least one head-cooling through-duct capable of transmitting the cooling air; and the cylinder-cooling ducts and the head-cooling duct extend in a direction perpendicular to the axial line of the cylinder, and are communicated with each other by means of at least one communicating channel formed on the cylinder block and the cylinder head.

Therefore, the cylinder-cooling ducts can pass through the vicinity of the cylinder, and the head-cooling duct can pass through the vicinity of the combustion chamber even in an air-cooled engine in which the power transmission mechanism for transmitting the power of the crankshaft to the camshaft, and the compartment for accommodating the power transmission mechanism, are disposed on the side of the cylinder head and on the side of the cylinder block. The cooling air can then be conducted to the vicinity of the combustion chamber and the cylinder by being admitted into the cylinder-cooling ducts and the head-cooling duct. Therefore, the combustion chamber and the cylinder can be cooled even more efficiently.

Furthermore, since the cylinder-cooling ducts and the cooling duct are communicated using communication channels, part of the cooling air flowing through the head-cooling duct can be admitted into the cylinder-cooling ducts and used as cooling air for the cylinder. Therefore, the cooling air needed to cool the cylinder can be adequately conducted to the cylinder. As a result, the cylinder cooling effect can be further improved.

It is preferable that the cylinder-cooling ducts be composed of a plurality of ducts, and that the one cylinder-cooling duct from among this plurality of cylinder-cooling ducts that is adjacent to the head-cooling duct be communicated with the head-cooling duct via the communicating channels. Therefore, cooling air can be passed through the plurality of cylinder-cooling ducts, and the vicinity of the cylinder can be cooled. Moreover, a greater amount of cooling air can be admitted into the cylinder-cooling duct adjacent to the head-cooling duct, i.e., the cylinder-cooling duct nearest to the combustion chamber. Therefore, the effects of cooling can be further improved by conducting a greater amount of cooling air to the vicinity of the combustion chamber and the cylinder.

The communication channels are preferably composed of a pair of separated communication channels. Therefore, part of the cooling air flowing through the head-cooling duct can be more adequately admitted into the cylinder-cooling ducts. As a result, the effects of cooling the cylinder can be further improved.

It is also preferable that the cylinder head have a valve chamber for accommodating a camshaft that operates an intake valve and an exhaust valve, and a guide-cooling duct communicated with the head-cooling duct; that the camshaft be driven by a crankshaft via a power transmission mechanism disposed along the cylinder; and that an inlet for the guide-cooling duct be formed in the cylinder head on the side opposite from the power transmission mechanism. Therefore, cooling air can be admitted into the head-cooling duct via the guide-cooling duct from the side opposite from the power transmission mechanism as well. Accordingly, the effects of cooling the combustion chamber and the cylinder can be further improved because a greater amount of cooling air can be made to flow into the head-cooling duct. Moreover, since an inlet for the guide-cooling duct is provided to the cylinder head on the side opposite from the power transmission mechanism, the inlet can easily be made to face outward. Accordingly, there is a greater degree of freedom when designing the position and shape of the guide-cooling duct.

The second embodiment of the present invention provides an air-cooled engine that is cooled by cooling air, comprising a crank case for accommodating a crankshaft, a cylinder block that is formed integrally on the crank case and is provided a cylinder having a reciprocating piston, and a base that is integrally formed on the crank case and can be mounted on arbitrary mating member by a plurality of fastening members; wherein the base has a plurality of mounting holes through which the fastening members can be inserted; the cylinder block is disposed at an incline in relation to the base and has a plurality of cooling fins formed integrally in the shape of a loop so as to encircle the outer periphery; and the cooling fins have the base-side halves disposed closer to the base in relation to the axial line of the cylinder and formed so as to be parallel to the center line of the mounting holes.

Therefore, when the crank case, cylinder block, and base are cast (i.e., when the casing is cast) as an integrated casting, the metal mold can be opened along the base-side halves of the cooling fins, whereby the direction of opening the metal mold is aligned with the orientation of the mounting holes. Therefore, the mounting holes can be formed at the same time as the casing is being cast in the metal mold. Matching the opening direction of the metal mold with the orientation of the mounting holes in this manner makes it possible to shape the mounting holes at the same time that the casing is being cast in the metal mold. Moreover, there is no need to provide the metal mold with a sliding die for shaping the mounting holes, and the metal mold can be simplified.

It is preferable that the cylinder block be disposed at a higher location than the base and be inclined upward in relation to the base; and that the engine also have a cooling fan for sending cooling air from the crank case to the base-side halves of the cooling fins. Therefore, the cooling air sent from the cooling fan can be more smoothly conducted to the cooling fins. Accordingly, the effects of cooling can be improved because the plurality of cooling fins and the cylinder block can be sufficiently cooled with cooling air. Furthermore, it is preferable that the cooling fan for blowing air has a plurality of blades, the plurality of blades have a bottommost blade, the bottommost blade has a distal end, and the distal end is disposed below the cooling fins.

It is also preferable that the cooling fins have base-side halves, the base-side halves have top ends, and the top ends be positioned on the axial line of the cylinder.

BRIEF DESCRIPTION OF THE DRAWINGS

Certain preferred embodiments of the present invention will be described in detail below, by way of example only, with reference to the accompanying drawings, in which.

BEST MODE FOR CARRYING OUT THE INVENTION

Figure 1:
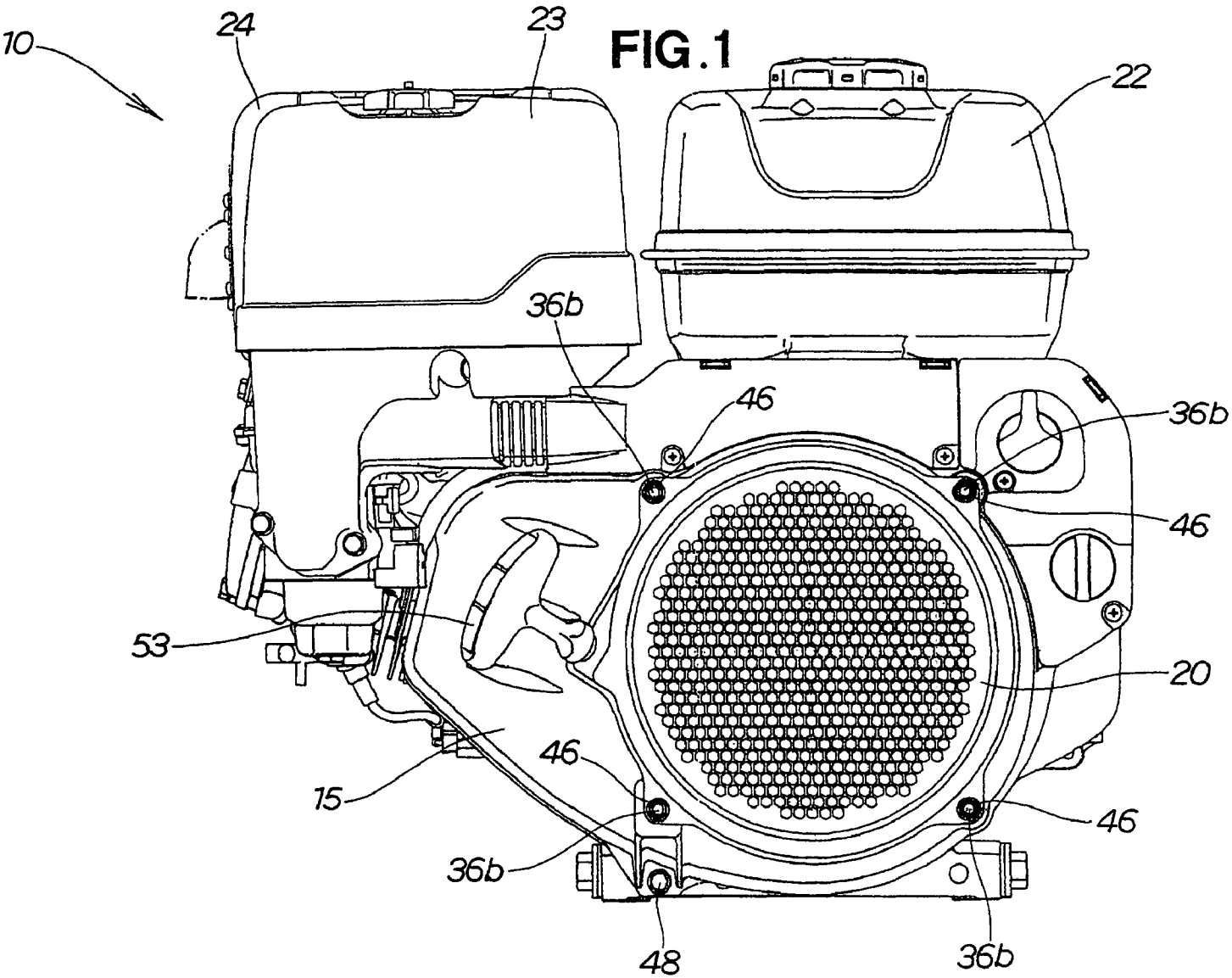
FIG. 1 is an external view of an air-cooled engine according to the present invention.
Figure 2:
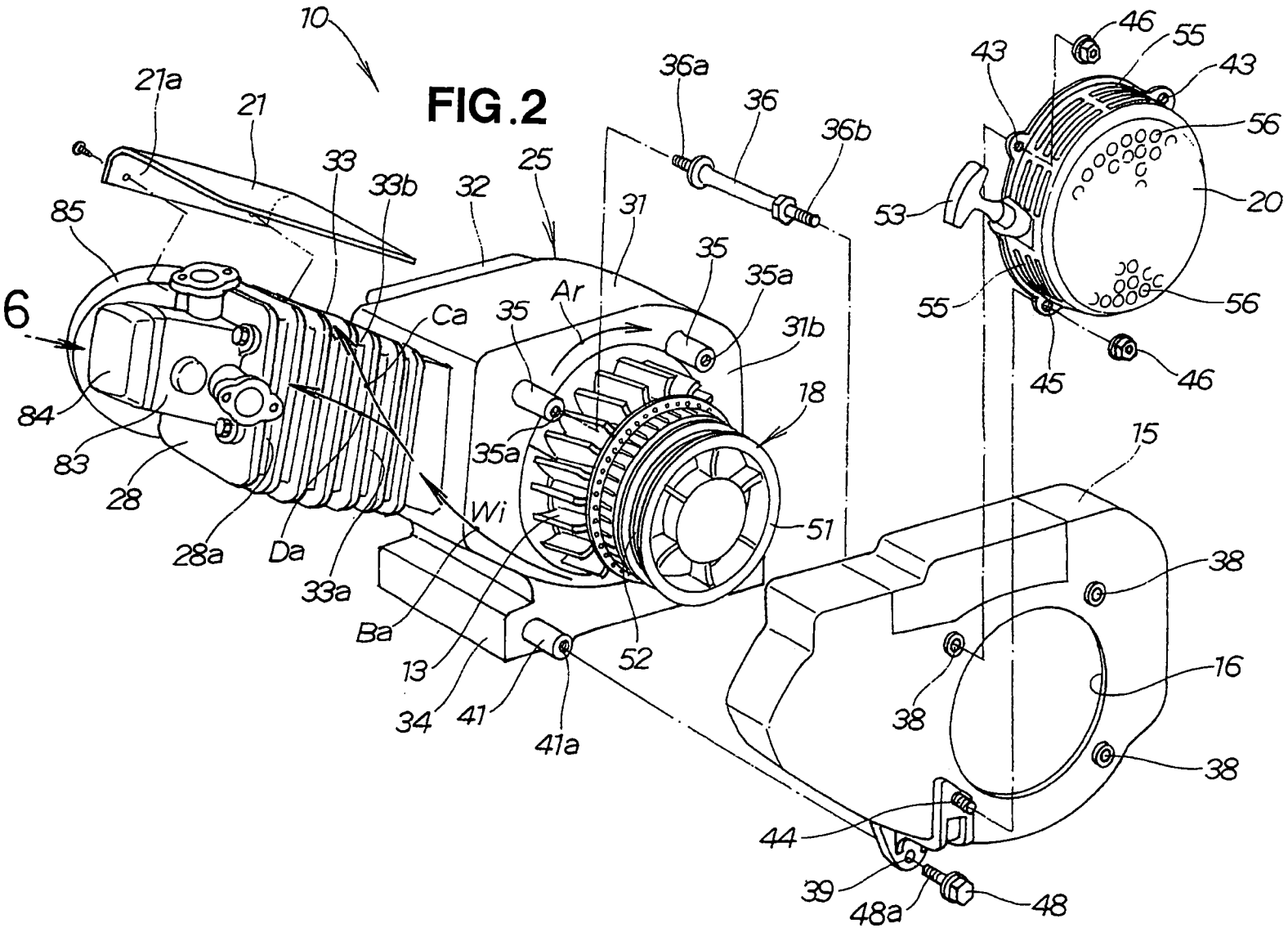
FIG. 2 is an exploded perspective view of the air-cooled engine shown in FIG. 1.

As shown in FIGS. 1 and 2, the air-cooled engine 10 comprises a cooling fan 13, a fan cover 15 that covers the cooling fan 13, a recoil starter 18, a starter cover 20 that covers the recoil starter 18, a fuel tank 22, an air cleaner 23, and a muffler 24.

Figure 3:
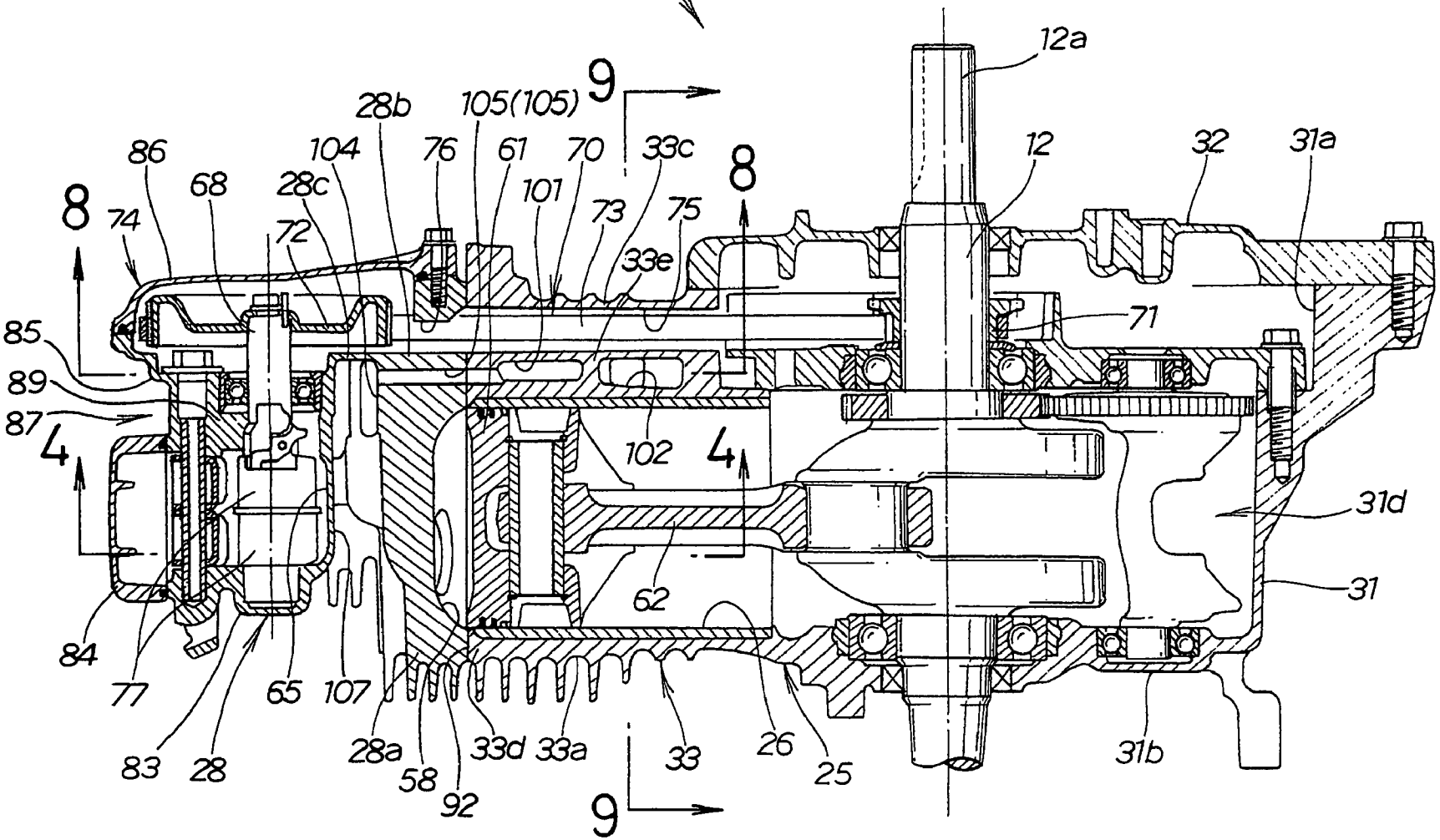
FIG. 3 is a cross-sectional view of the air-cooled engine shown in FIG. 1.

The cooling fan 13 and the recoil starter 18 are linked with a crankshaft 12 (see FIG. 3). The fan cover 15 has an opening 16 through which the recoil starter 18 passes.

As shown in FIGS. 2 and 3, the air-cooled engine 10 is a so-called OHC (overhead-cam) single-cylinder engine having a tilted cylinder, wherein a single cylinder 26 and a cylinder block 33 are tilted upward at fixed angles in relation to a horizontal base 34 located at the bottom of a crank case 31. The air-cooled engine 10 is described in detail hereinbelow.

The casing 25 of the air-cooled engine 10 is composed of a crank case 31, a case cover 32 that closes off the opening 31*a* of the crank case 31, a cylinder block 33 formed integrally on the side of the crank case 31 (the left end in FIG. 2), and a horizontal base 34 formed integrally on the bottom of the crank case 31.

The crank case 31 has a crank chamber 31*d* (accommodating space 31*d*) that rotatably accommodates the crankshaft 12. The opening 31*a* of the crank case 31 can be covered with the case cover 32 by bolting the case cover 32 onto the crank case 31. The crankshaft 12 has a power output unit 12*a* used to output the generated power and located at the end that extends through and past the case cover 32.

The cylinder block 33 and the cylinder 26 housed within the cylinder block 33 are tilted upward from the side portion of the crank case 31. Therefore, the cylinder 26 and the cylinder block 33 are disposed farther up than the base 34, and are tilted upward in relation to the base 34.

The crank case 31 comprises three bosses 35 (only two are shown) on one side 31*b*, and one boss 41 disposed at a position separate from the three bosses 35, as shown in FIG. 2. The three bosses 35 have the threaded parts 36*a* of stud bolts 36 screwed into screw holes 35*a*. The three stud bolts 36 are thus mounted on one side 31*b* of the crank case 31. The stud bolts 36 also have threaded parts 36*b* at their distal ends.

The procedure of attaching the fan cover 15 and the starter cover 20 is as follows.

First, the three threaded parts 36*b* are inserted into three mounting holes 38 in the fan cover 15. At the same time, the position of a mounting hole 39 in the fan cover 15 is matched with a screw hole 41*a* in a boss 41.

Next, the three threaded parts 36*b* are inserted through the three mounting holes 43 (only two are shown) in the starter cover 20. At the same time, a bolt 44 in the fan cover 15 is inserted into a mounting hole 45 in the starter cover 20.

Next, nuts 46 are screwed over the three threaded parts 36*b* and the bolt 44.

Furthermore, a bolt 48 is inserted through the mounting hole 39 in the fan cover 15, and a threaded part 48*a* is screwed into the screw hole 41*a* in the boss 41.

The fan cover 15 can thus be attached to one side 31*b* of the crank case 31, and the starter cover 20 can be attached to the fan cover 15.

As shown in FIG. 2, the recoil starter 18 includes a pulley 51 linked with the crankshaft 12 (see FIG. 3), and a starter rope 52 that is wound around the pulley 51. The starter rope 52 has a grip 53 at the distal end. FIG. 2 shows the grip 53 as being detached from the starter rope 52 and positioned on the side of the starter cover 20, for the sake of simplicity.

As shown in FIG. 2, the air-cooled engine 10 comprises a guide cover 21 that covers the tops of both the cylinder head 28 and the cylinder block 33. The guide cover 21 performs the function of guiding cooling air Wi from the cooling fan 13 along the top portion 33*b* of the cylinder block 33. The cover is bolted onto the cylinder head 28 and the cylinder block 33.

Next, the cross-sectional structure of the air-cooled engine 10 will be described.

As shown in FIG. 3, a piston 61 is reciprocatingly accommodated within the cylinder 26 and is linked with the crankshaft 12 via a connecting rod 62.

Figure 4:
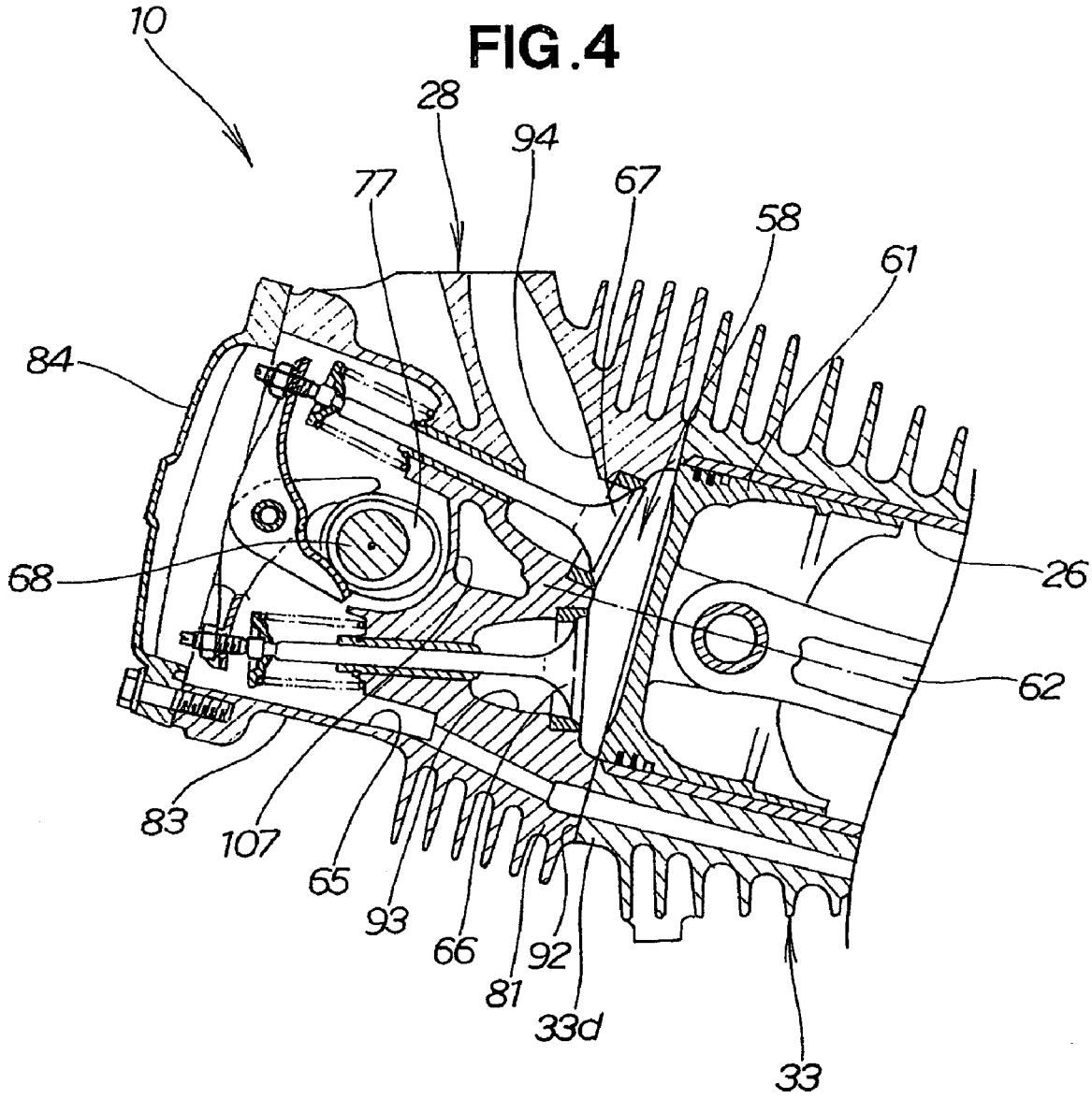
FIG. 4 is a cross-sectional view along the line 4-4 in FIG. 3.

As shown in FIGS. 3 and 4, the cylinder head 28 is superposed on and bolted to the distal end surface of the cylinder block 33, i.e., the head 33*d*. The cylinder head 28 is a member that closes off one end of the cylinder 26. A combustion chamber 58 is formed in the area that faces the head 33*d*, and a valve chamber 65 is formed adjacent to the combustion chamber 58 on the side opposite from the combustion chamber 58. The valve chamber 65 accommodates an intake valve 66, an exhaust valve 67, and a camshaft 68.

The camshaft 68 is linked with the crankshaft 12 via a power transmission mechanism 70. The power transmission mechanism 70 transmits drive force from the crankshaft 12 to the camshaft 68, and is disposed along the cylinder 26 and the combustion chamber 58. The power transmission mechanism 70 is composed of a drive pulley 71 mounted on the crankshaft 12, a driven pulley 72 mounted on the camshaft 68, and a belt 73 wound over the drive pulley 71 and the driven pulley 72.

The rotation of the crankshaft 12 brings about rotation of the drive pulley 71, the belt 73, the driven pulley 72, the camshaft 68, and a pair of cams 77, 77. As a result, the intake valve 66 and the exhaust valve 67 operate to open and close an intake port and an exhaust port that face the combustion chamber 58. The intake valve 66 and the exhaust valve 67 can be opened and closed in synchronization with the rotation timing of the crankshaft 12.

As shown in FIG. 3, the power transmission mechanism 70 is accommodated in a transmission mechanism compartment 74. The transmission mechanism compartment 74 is composed of belt insertion slots 75, 76, a pulley compartment 85, and a pulley cover 86. The belt insertion slot 75 is formed on the other lateral portion 33*c* of the cylinder block 33. The belt insertion slot 76 is formed on the other side 28*b* of the cylinder head 28. The belt 73 is passed through the belt insertion slots 75, 76.

Figure 5:
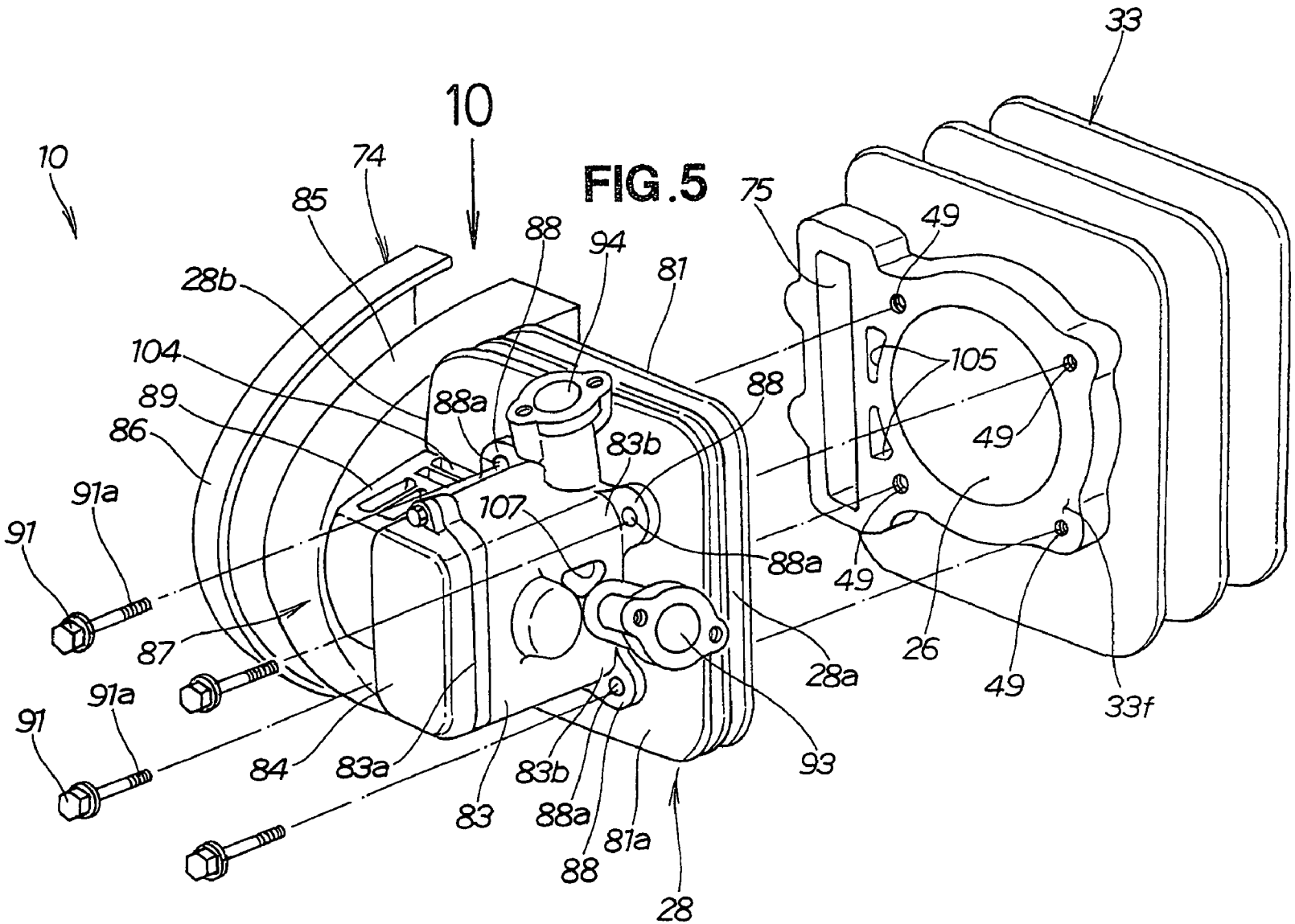
FIG. 5 is an exploded perspective view of the area surrounding the cylinder head in the air-cooled engine shown in FIG. 2.
Figure 6:
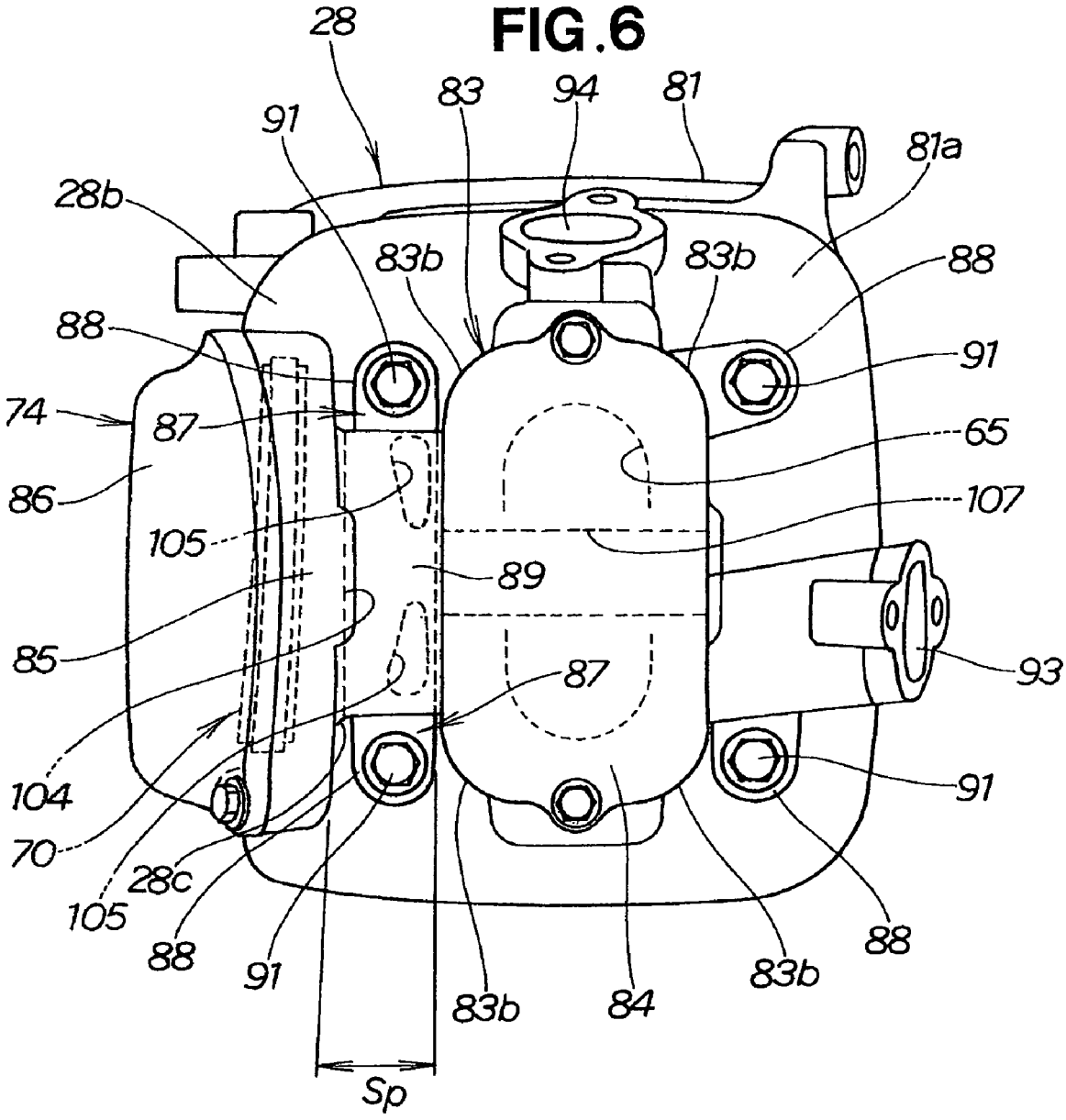
FIG. 6 is a view along the arrow line 6 in FIG. 2.

As shown in FIGS. 5 and 6, the cylinder head 28 is an integrated casting composed of a base part 81, a valve compartment 83, the pulley compartment 85, and a coupler 89.

The base part 81 is a flat discoid member that is superposed on the end surface 33*f* (flange surface 33*f*) of the cylinder block 33, and has an intake port 93 and an exhaust port 94 (see also FIG. 4).

The valve compartment 83 is located on the surface 81*a* of the base part 81 on the side opposite from the cylinder block 33. The distal open surface 83*a* (flange surface 83*a*) of the valve compartment 83 is closed off by a head cover 84. The head cover 84 is bolted onto the valve compartment 83. The outer shape of the valve compartment 83 is substantially rectangular when the valve compartment 83 is viewed from the side of the head cover 84.

The valve chamber 65 (see FIG. 4) constitutes an internal space in the valve compartment 83 that is closed off by the head cover 84. As described above, the intake valve 66, the exhaust valve 67, and the camshaft 68 can be accommodated in the valve chamber 65 inside the valve compartment 83. It is apparent that the valve compartment 83 has the internally disposed valve chamber 65 and is therefore one size larger than the outer shape of the valve chamber 65.

The pulley compartment 85 is a member for accommodating the driven pulley 72 (see FIG. 3), and the open end thereof is closed off by the pulley cover 86. More specifically, the pulley compartment 85 is placed at a specific distance Sp from the valve compartment 83 (i.e., the valve chamber 65) towards the other side 28*b* of the cylinder head 28, as shown in FIG. 6.

Thus, at least part of the transmission mechanism compartment 74, i.e., the pulley compartment 85 is formed in the cylinder head 28 at a specific gap 87 from the valve compartment 83. As a result, a space 87 (gap 87) having a specified dimension Sp can be maintained between the valve compartment 83 and the pulley compartment 85, as shown in FIGS. 3, 5, and 6. The provision of this space 87 allows the valve compartment 83 and the pulley compartment 85 to be integrally formed by means of the coupler 89 through which the camshaft 68 passes.

The coupler 89 has a head-cooling duct 104 formed between the valve compartment 83 and the pulley compartment 85. The head-cooling duct 104 serves as a duct through which cooling air flows.

As shown in FIGS. 5 and 6, the base part 81 has a plurality of bosses 88 on the surface 81*a* on the side opposite from the cylinder block 33. This plurality (four, for example) of bosses 88 are disposed at the four corners 83*b* surrounding the valve compartment 83. The bosses 88 have a plurality of mounting holes 88*a* through which the base part 81 is passed. The positions of the plurality of mounting holes 88*a* coincide with the positions of the plurality of screw holes 49 formed on the flange surface 33*f* of the cylinder block 33.

The procedure for fastening the cylinder head 28 to the cylinder block 33 is as follows.

First, as shown in FIGS. 4 and 5, a gasket 92 (seal member 92) is set into the flange surface 33*f* of the cylinder block 33, and the base part 81 is superposed thereon.

Next, a plurality of head bolts 91 (hereinbelow referred to simply as "bolts 91") are inserted into the plurality of mounting holes 88*a* from the end surface 81*a* of the base part 81, and threaded portions 91*a* are allowed to protrude out and are screwed into the screw holes 49, completing the operation.

As described above, the four mounting holes 88*a* and the four bolts 91 are disposed nearer to the four outer corners 83*b* away from the valve compartment 83, i.e., in the areas outside of the valve chamber 65. Therefore, the lubricating oil in the valve chamber 65 does not pass through the mounting holes 88*a* and does not leak (seep out, for example) between the cylinder head 28 and the cylinder block 33.

Therefore, there is no need to adopt oil-sealing measures, such as placing a gasket 92 with a complicated shape between the cylinder head 28 and the cylinder block 33, in order to prevent oil from leaking from the valve chamber 65. The air-cooled engine 10 can therefore have a simpler structure.

Furthermore, since all of the bolts 91 are disposed at the four corners 83*b* outside of the valve compartment 83, the service conditions (temperature and the like) of the bolts 91 can be kept substantially identical. The thermal strain in the bolts 91 can be made uniform, and uniform and favorable thermal strain can therefore be preserved in the cylinder 26 and the combustion chamber 58 (see FIG. 4). Moreover, the durability of the bolts 91 can be sufficiently improved because the thermal strain in the bolts 91 is uniform.

There is also no need to dispose the bolts 91 inside the valve chamber 65, because all the bolts 91 are disposed in areas outside of the valve compartment 83. The size of the air-cooled engine 10 can be reduced by reducing the size of the valve compartment 83 in proportion to the absence of the space for accommodating the bolts 91 in the valve chamber 65.

Furthermore, since the valve compartment 83 is smaller, it is possible to increase the surface area of the portion of the cylinder head 28 exposed in the vicinity of the combustion chamber 58, i.e., the radiating surface area. Moreover, the distance from the outer surface of the valve compartment 83 to the combustion chamber 58 can be reduced because the valve compartment 83 is smaller. Therefore, cooling air can be conducted to near the combustion chamber 58. As a result, the area surrounding the combustion chamber 58 in the cylinder head 28 can be cooled more adequately, and cooling efficiency can be improved.

Furthermore, the two left-hand side bolts 91, 91 (some of the bolts) out of the four bolts 91 are disposed between the valve compartment 83 and the transmission mechanism compartment 74. Therefore, the two left-hand side head bolts 91, 91 can be disposed in the vicinity of the valve compartment 83 in the same manner as the other two head bolts 91, 91. As a result, the service temperature of all the bolts 91 can be made even more uniform. The thermal strain in all the bolts 91 can thereby be made more uniform.

Next, the cooling duct of the air-cooled engine 10 will be described.

As shown in FIG. 3, the cylinder block 33 has two cylinder-cooling ducts 101, 102, i.e., a first cylinder-cooling duct 101 and a second cylinder-cooling duct 102, for conducting cooling air to the area 33*e* between the cylinder 26 and the belt insertion slot 75.

As shown in FIGS. 3 and 7 through 9, the first cylinder-cooling duct 101 is aligned vertically in a direction that intersects the axial line 109 (see FIG. 7) of the cylinder 26. The first cylinder-cooling duct 101 has a top inlet 101*a* that opens into the top of the cylinder block 33, and a bottom outlet 101*b* that opens into the bottom of the cylinder block 33.

The second cylinder-cooling duct 102 is substantially parallel to the first cylinder-cooling duct 101, is disposed farther away from the cylinder head 28 than the first cylinder-cooling duct 101, and is aligned vertically. The second cylinder-cooling duct 102 has a top inlet 102*a* that opens into the top of the cylinder block 33, and a bottom outlet 102*b* that opens into the bottom of the cylinder block 33.

The cylinder head 28 has two cooling ducts 104, 107, i.e., a head-cooling duct 104 and a guide-cooling duct 107, for conducting cooling air in the manner shown in FIGS. 3, 7, 8, and 10.

The head-cooling duct 104 is aligned vertically in the area 28*c* between the valve chamber 65 and the belt insertion slot 76, and is substantially parallel to the first and second cylinder-cooling ducts 101, 102. The head-cooling duct 104 has a top inlet 104*a* that opens into the top of the cylinder head 28, and a bottom outlet 104*b* that opens into the bottom of the cylinder head 28.

Figure 7:
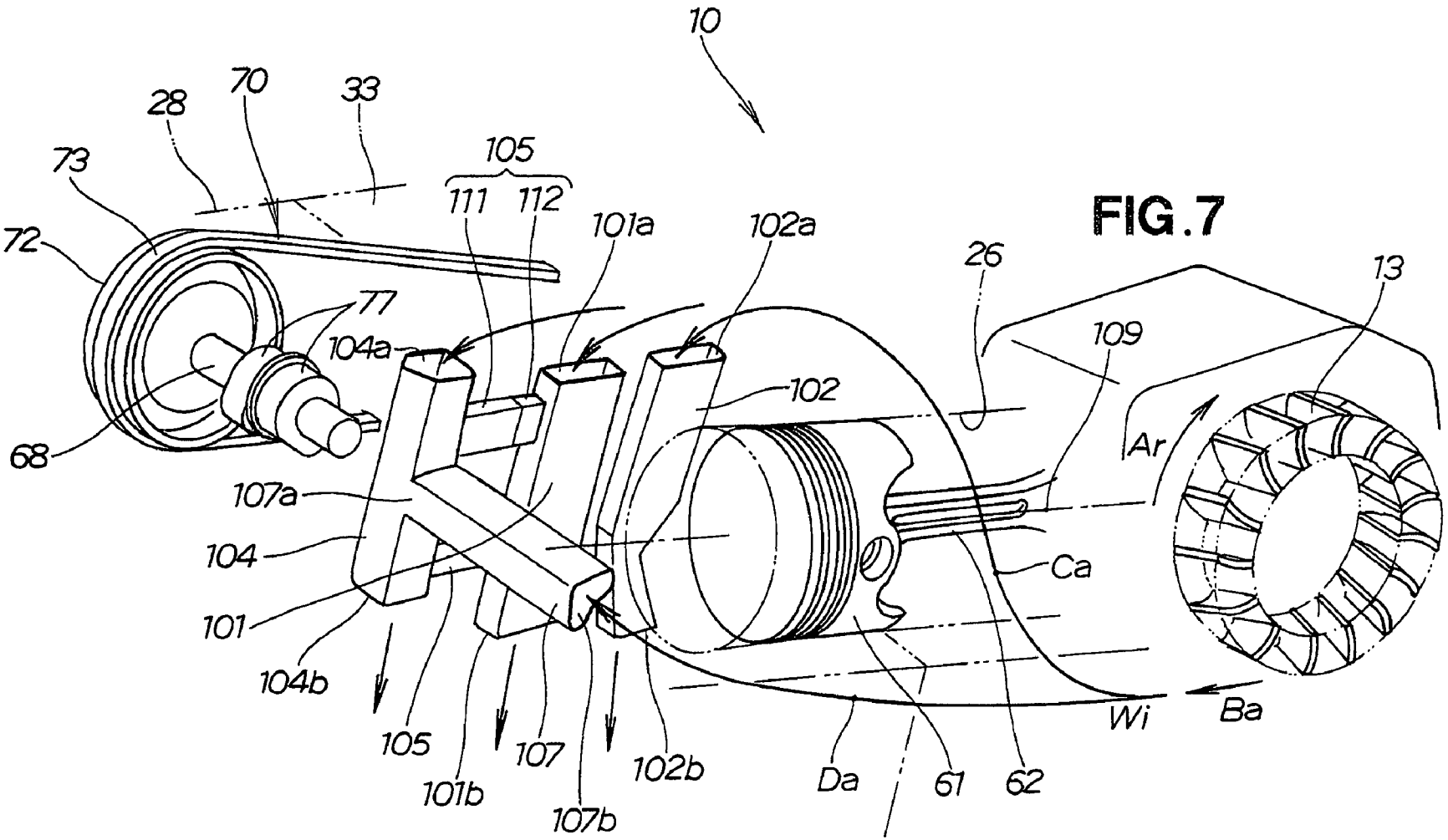
FIG. 7 is a diagram describing the cooling ducts in the air-cooled engine shown in FIG. 2.
Figure 8:
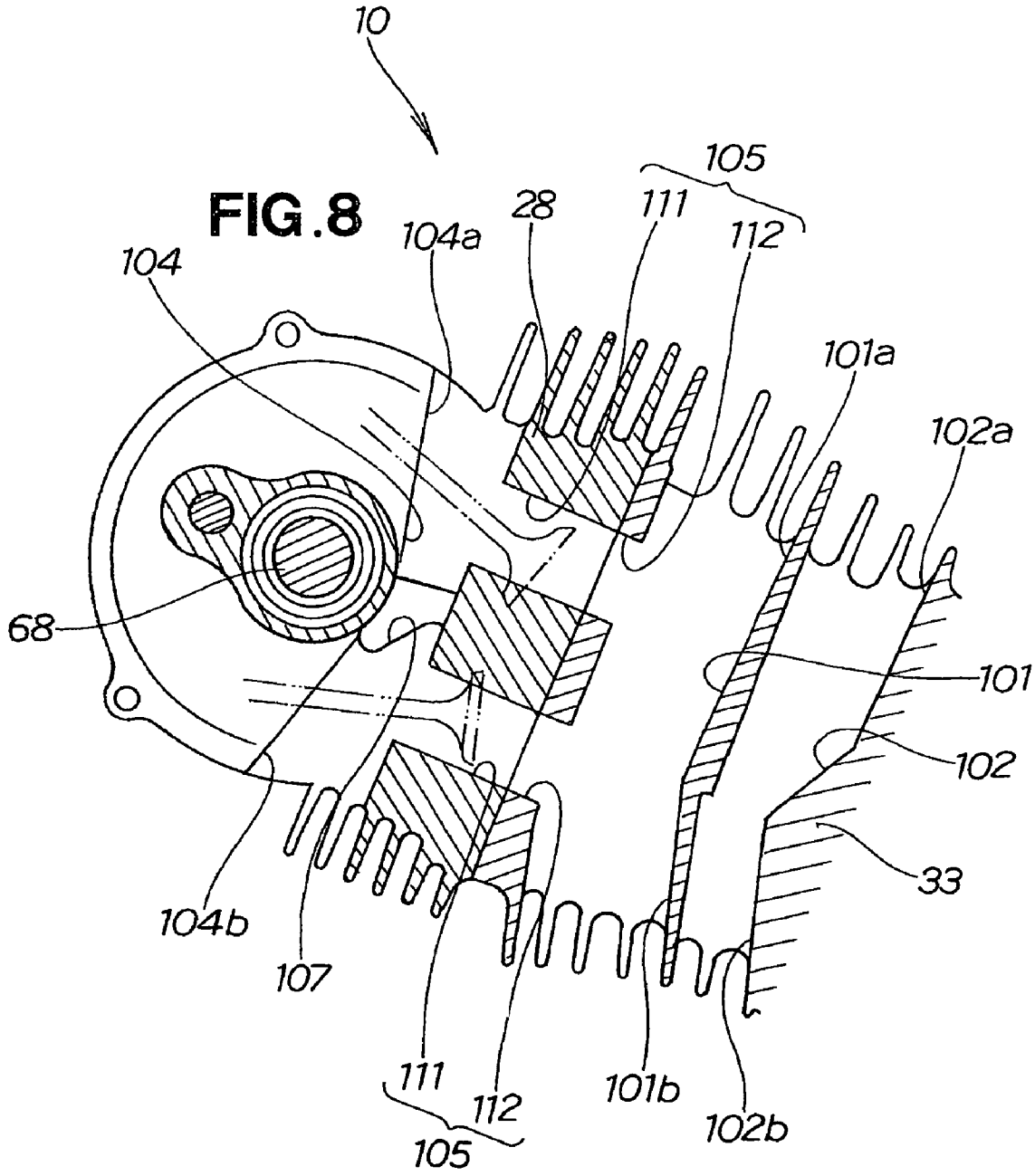
FIG. 8 is a cross-sectional view along the line 8-8 in FIG. 3.

As shown in FIGS. 7 and 8, the head-cooling duct 104 is communicated with the first cylinder-cooling duct 101 by means of a pair of communicating channels 105, 105. The pair of communicating channels 105, 105 are formed at a fixed distance from each other. The communicating channels 105 are composed of a head-side communicating channel 111 formed in the cylinder head 28, and a cylinder-side communicating channel 112 formed in the cylinder block 33.

As shown in FIGS. 3, 7, and 8, the guide-cooling duct 107 is formed in a direction substantially orthogonal to the head-cooling duct 104. This guide-cooling duct 107 has an outlet 107*a* that is communicated with the substantial center of the head-cooling duct 104, and an inlet 107*b* that opens into the lateral portion 28*a* (see FIG. 3) opposite from the pulley compartment 85, i.e., in the first lateral portion 28*a*. Providing the inlet 107*b* to the lateral portion 28*a* opposite from the pulley compartment 85 makes it easier to make the inlet 107*b* face the exterior. Therefore, there is a high degree of freedom in designing the engine, and productivity can be improved because it is possible to easily set the shape of the guide-cooling duct 107 and the arrangement of the guide-cooling duct 107 in relation to the cylinder head 28. Moreover, cooling air can easily be admitted into the guide-cooling duct 107 from the inlet 107*b*.

A summary of the above description is as follows. As shown in FIG. 7, the first and second cylinder-cooling ducts 101, 102, the head-cooling duct 104, and the guide-cooling duct 107 extend in a direction perpendicular to the axial line 109 of the cylinder 26. The first cylinder-cooling duct 101 is adjacent to the head-cooling duct 104 and is communicated with the head-cooling duct 104 via the communicating channels 105, 105.

Next, the manner in which cooling air flows from the cooling fan 13 will be described.

As shown in FIG. 2, the cooling fan 13 is rotated in the direction of the arrow Ar by the crankshaft 12 (see FIG. 3). The rotating cooling fan 13 expels outside air that has been drawn in from the outside air inlets 55, 56 towards the first lateral portion 33*a* of the cylinder block 33 (in the direction of the arrow Ba). The expelled outside air constitutes cooling air Wi for cooling the air-cooled engine 10.

Part of the cooling air Wi flows upward, as shown by the arrow Ca, from the first lateral portion 33*a* of the cylinder block 33, and is conducted along the top portion 33*b* of the cylinder block 33 by the guide cover 21. The cooling air Wi conducted along the top portion 33*b* is directed downward by a curved part 21*a* of the guide cover 21. The cooling air Wi that has been directed downward is conducted down along the other lateral portion 33*c* of the cylinder block 33 shown in FIG. 3.

In FIG. 2, the remaining part of the cooling air Wi, moving as shown by the arrow Ba, is conducted as shown by the arrow Da along one lateral portion 28*a* of the cylinder head 28.

The cooling air Wi flowing upward as shown by the arrow Ca is admitted into the top inlets 101*a*, 102*a*, 104*a*, as shown in FIGS. 11A, 11B, 12A, and 12B. The cooling air Wi flowing to the side as shown by the arrow Da is admitted into the inlet 107*b*.

The cooling air Wi admitted into the top inlet 101*a* flows through the first cylinder-cooling duct 101 and then flows out from the bottom outlet 101*b*, as shown by the arrow Ea. The cooling air Wi admitted into the top inlet 102*a* flows through the second cylinder-cooling duct 102 and then flows out from the bottom outlet 102*b*, as shown by the arrow Fa.

Figure 9:
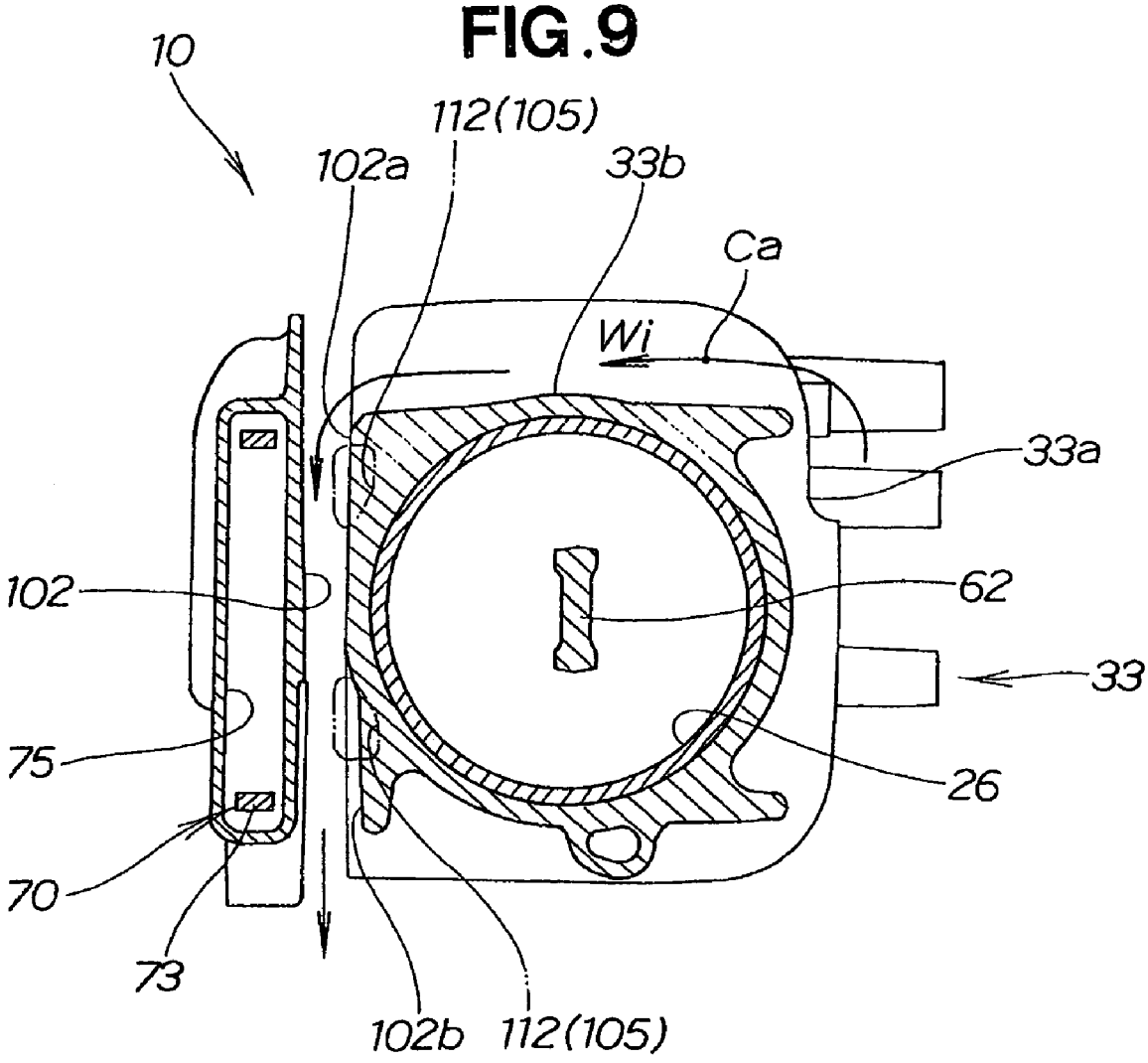
FIG. 9 is a cross-sectional view along the line 9-9 in FIG. 3.
Figure 10:
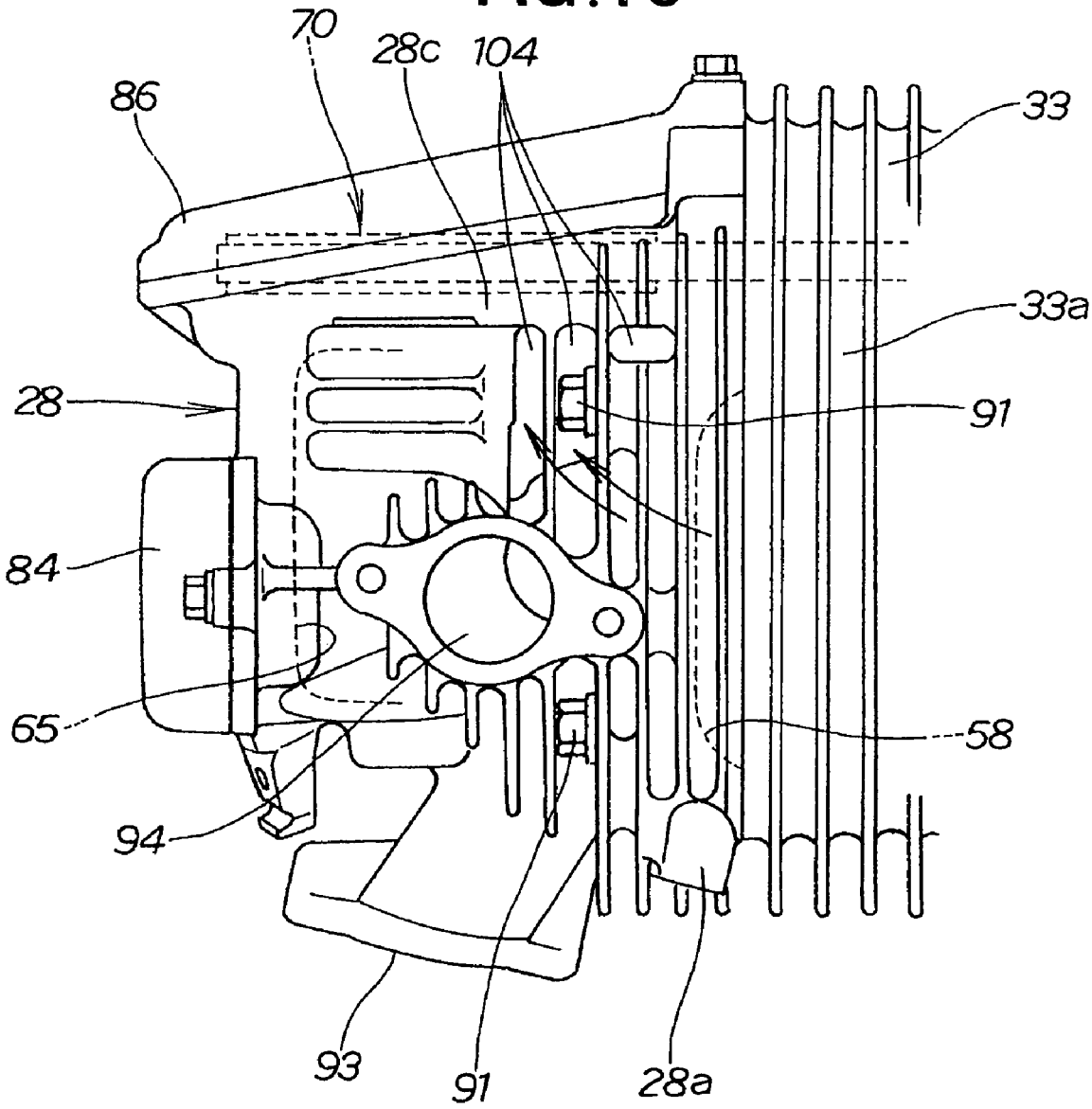
FIG. 10 is a view along the arrow 10 in FIG. 5.

Specifically, the cooling air Wi flows from the first lateral portion 33*a* to the top portion 33*b* of the cylinder block 33, as shown by the arrow Ca in FIG. 9. The cooling air Wi that has flowed over the top portion 33*b* is admitted into the top inlet 102*a* and is caused to flow through the first cylinder-cooling duct 102 and then out from the bottom outlet 102*b*. The same is true for the cooling air Wi that flows through the first cylinder-cooling duct 101 (see FIGS. 12A and 12B).

Thus, a large amount of cooling air Wi can be made to flow to the vicinity of the cylinder 26 because the cooling air Wi flows through two cooling ducts, which are the first and second cylinder-cooling ducts 101, 102. As a result, the area surrounding the cylinder 26 can be cooled efficiently by the cooling air Wi.

Figure 12A:
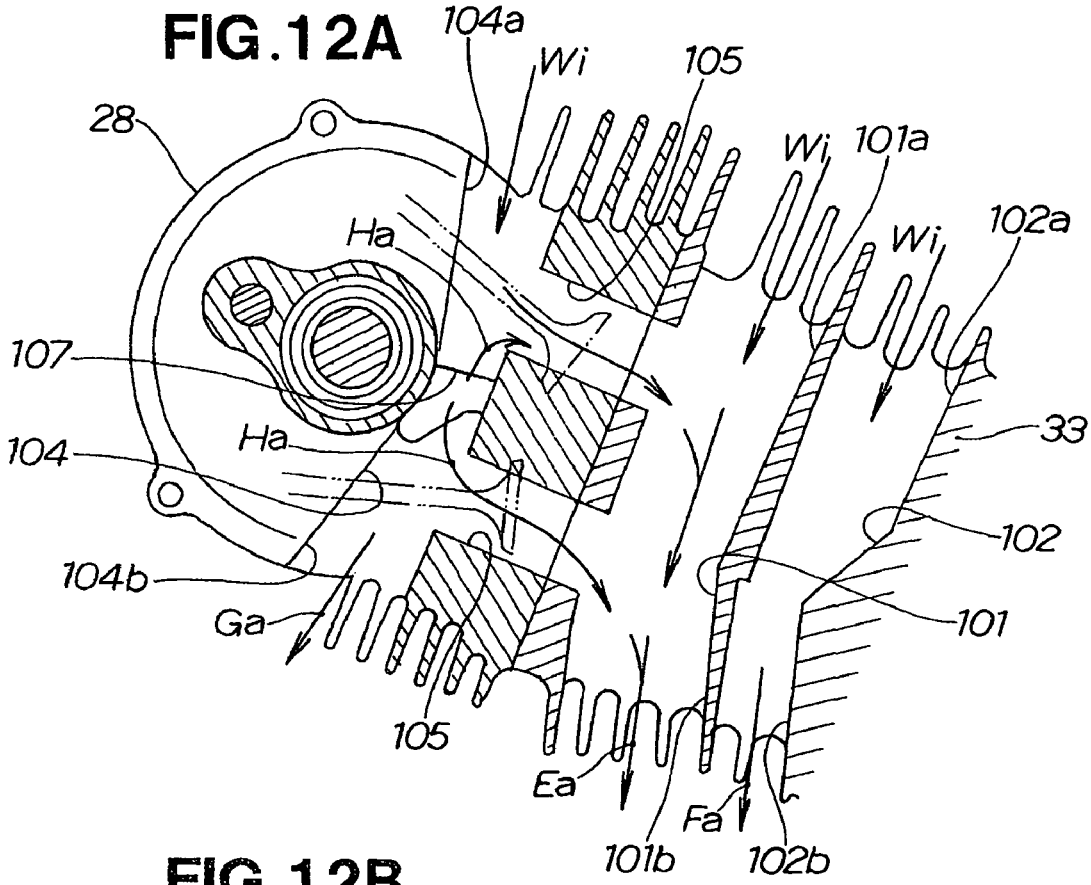
FIGS. 12A and 12B are diagrams describing the manner in which cooling air flows through the cooling ducts shown in FIGS. 3 and 8.

As shown in FIG. 12A, the cooling air Wi admitted into the top inlet 104*a* flows through the head-cooling duct 104 and then out from the bottom outlet 104*b*, as shown by the arrow Ga. Admitting the cooling air Wi into the head-cooling duct 104 allows the cooling effects of the cylinder head 28 to be further improved. More specifically, the cooling air flows from the first lateral portion 28*a* of the cylinder head 28, as shown by the arrow in FIG. 10. The cooling air that has flowed over the first lateral portion 28*a* is conducted through the top inlet 104*a* and is caused to flow through the head-cooling duct 104.

Figure 11A:
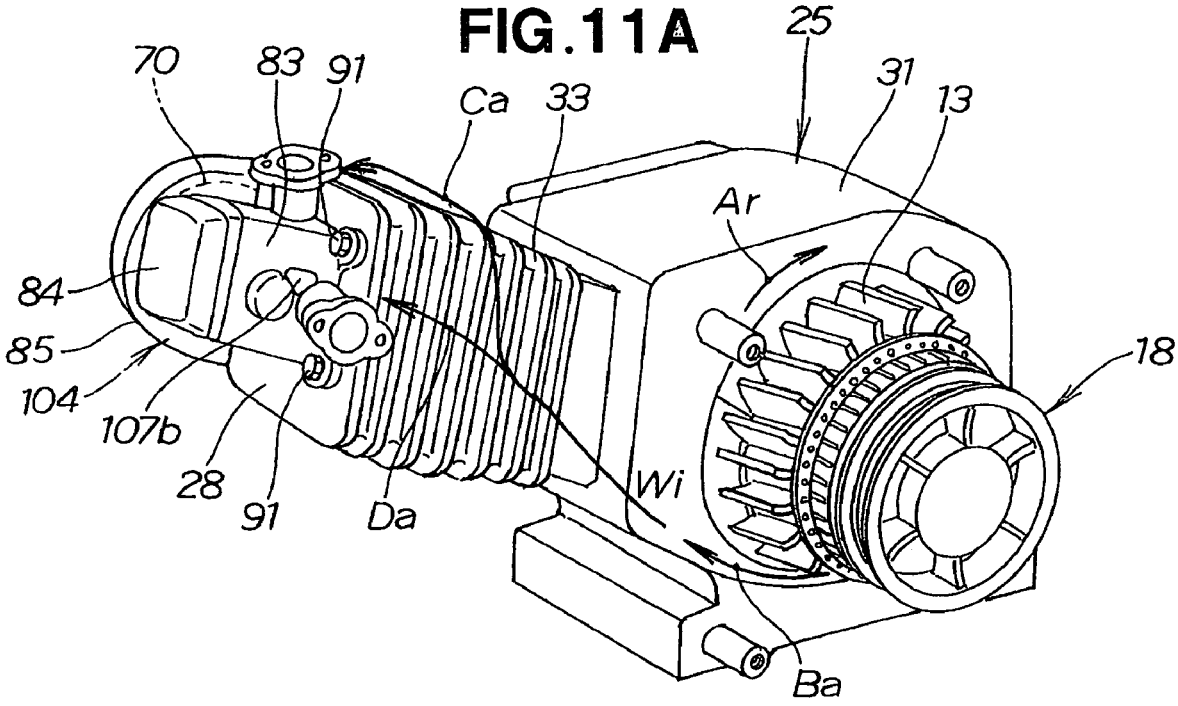
FIGS. 11A and 11B are diagrams describing the manner in which cooling air is conducted through the cooling ducts in the air-cooled engine shown in FIGS. 2 and 7.
Figure 11B:
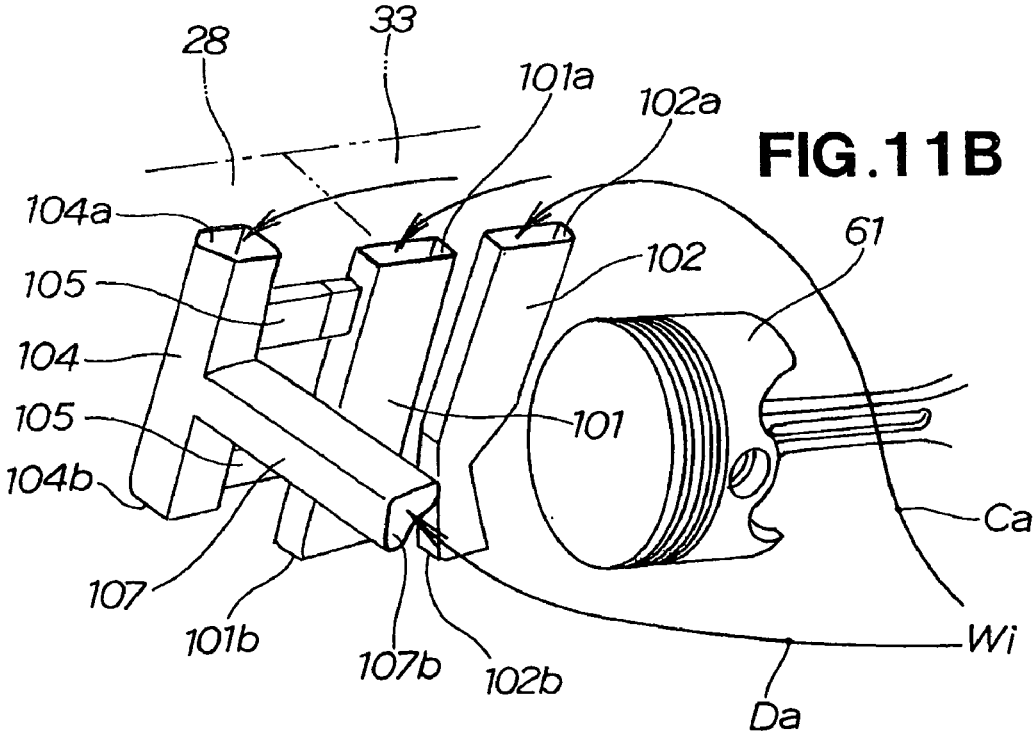
Figure 12B:
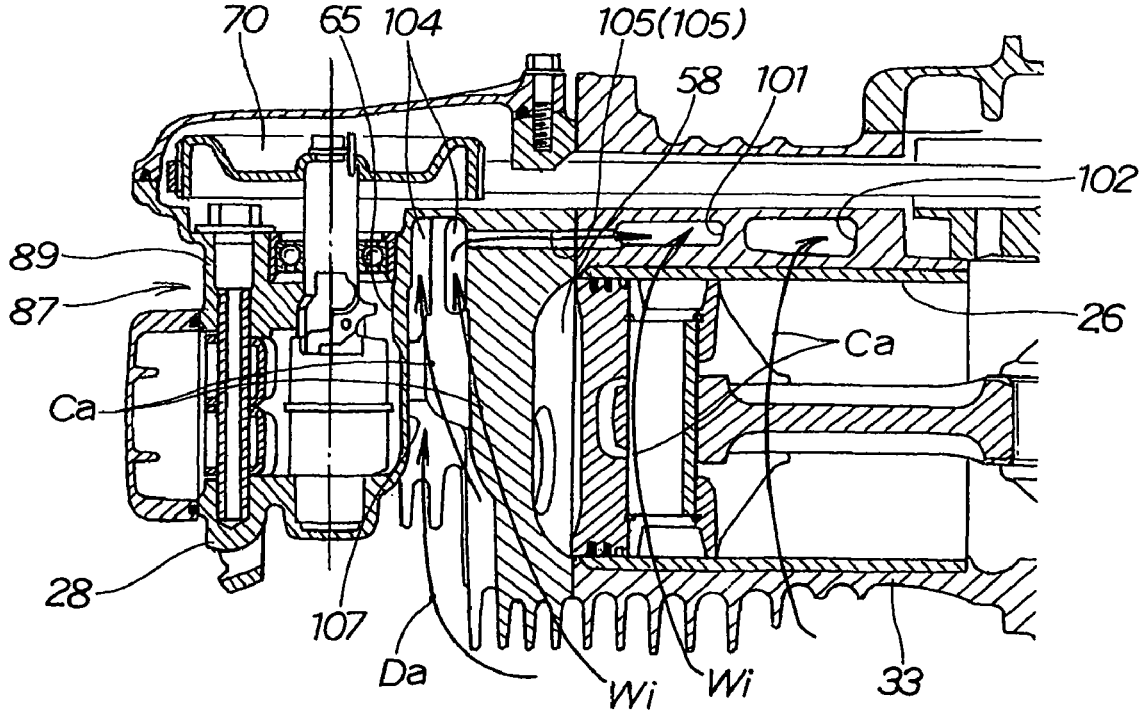

As shown in FIGS. 11B, 12A, and 12B, the cooling air Wi admitted into the inlet 107*b* flows into the guide-cooling duct 107, enters the head-cooling duct 104, and mixes with the cooling air Wi from the top inlet 104*a*. Accordingly, a large amount of cooling air Wi can be made to flow through the head-cooling duct 104. Part of the cooling air Wi that flows through the head-cooling duct 164 passes through a pair of communicating channels 105, 105 and flows into the first cylinder-cooling duct 101, as shown by the arrow Ha.

Since the head-cooling duct 104 and the first cylinder-cooling duct 101 are thus linked by a pair of communicating channels 105, 105, the cooling air Wi that has flowed over the cylinder head 28 can be adequately conducted to the cylinder block 33. The cooling air Wi needed to cool the cylinder 26 can thereby be adequately conducted to the cylinder 26. Cooling air Wi can be allowed to flow in the vicinity of the combustion chamber 58 to efficiently cool both the cylinder head 28 and the cylinder block 33. This is achieved by conducting cooling air Wi to the head-cooling duct 104 and the first cylinder-cooling duct 101.

Next, the relationship between the tilted cylinder block 33 and the base 34 in the air-cooled engine 10 will be described in detail.

The casing 25, the cylinder head 28, the case cover 32, the head cover 84, and the pulley cover 86, all shown in FIG. 3, are cast articles (die-cast, for example) made of an aluminum alloy.

Figure 13:
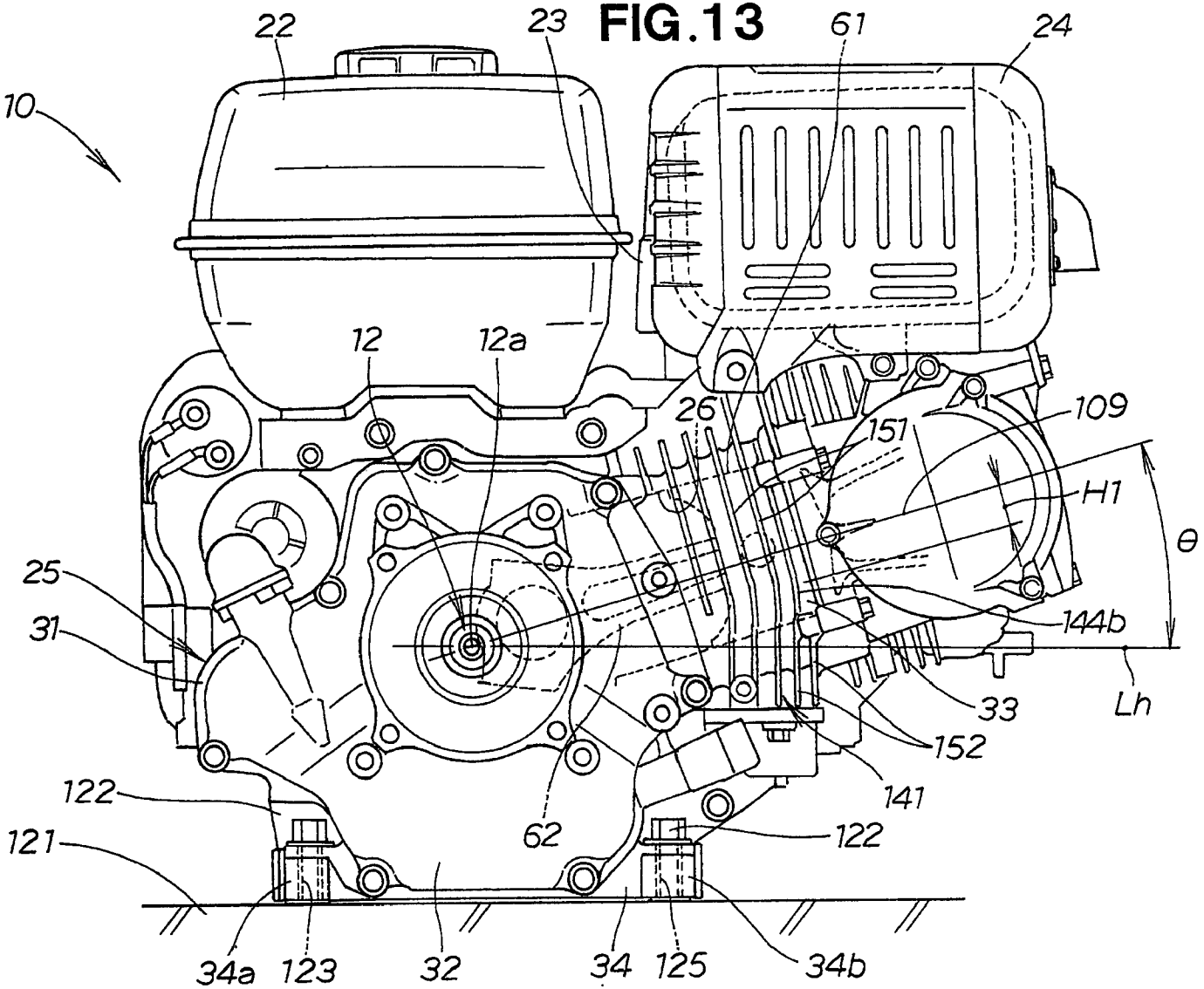
FIG. 13 is a view of the air-cooled engine shown in FIG. 1, as seen from the opposite side.

As shown in FIG. 13, the axial line 109 of the cylinder 26 (the cylinder axis 109) is inclined upward at an angle θ in relation to a horizontal line Lh passing through the crankshaft 12. In other words, θ is the angle of inclination of the cylinder 26 in relation to the base 34.

Figure 14:
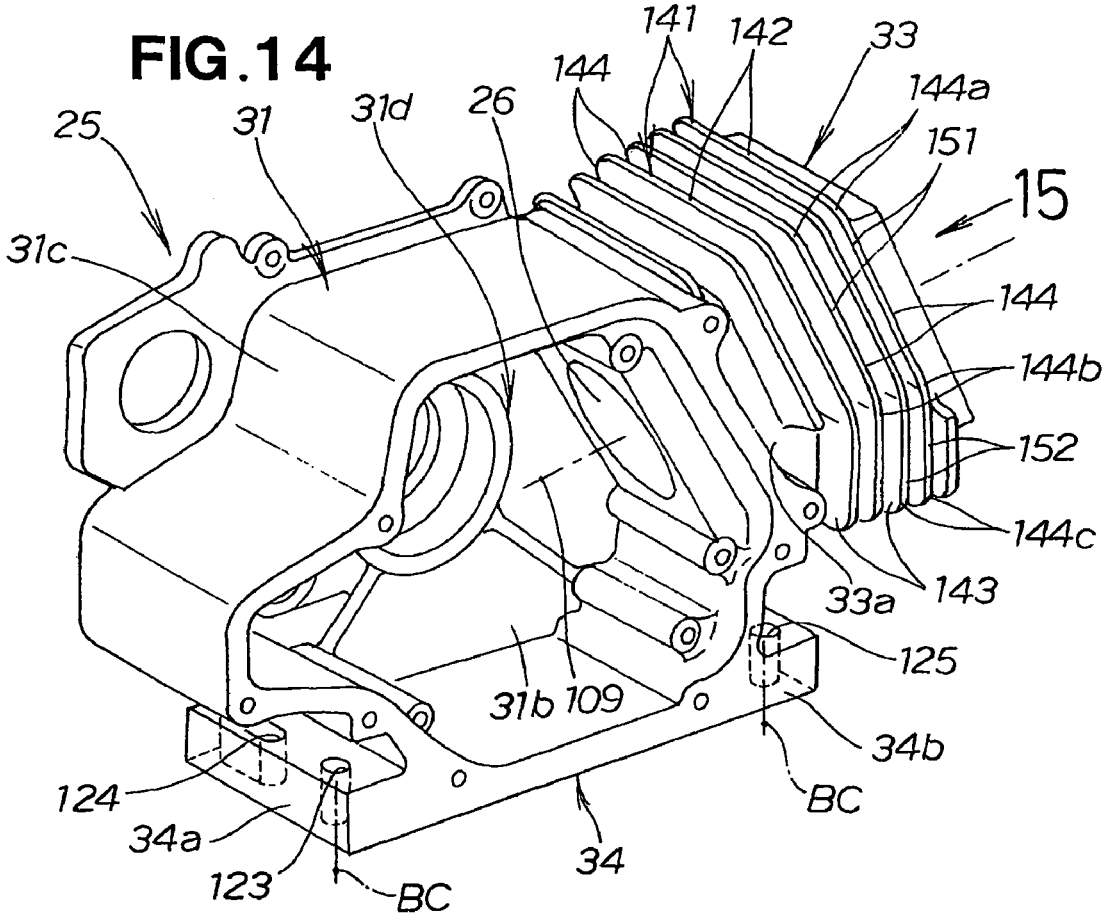
FIG. 14 is a perspective view of the casing shown in FIG. 13.

As shown in FIGS. 13 and 14, the casing 25 can be mounted on a mounting stand 121 (arbitrary mating member 121 or arbitrary mounting location 121) with bolts 122. The bolts 122 are the fastening members.

Figure 16:
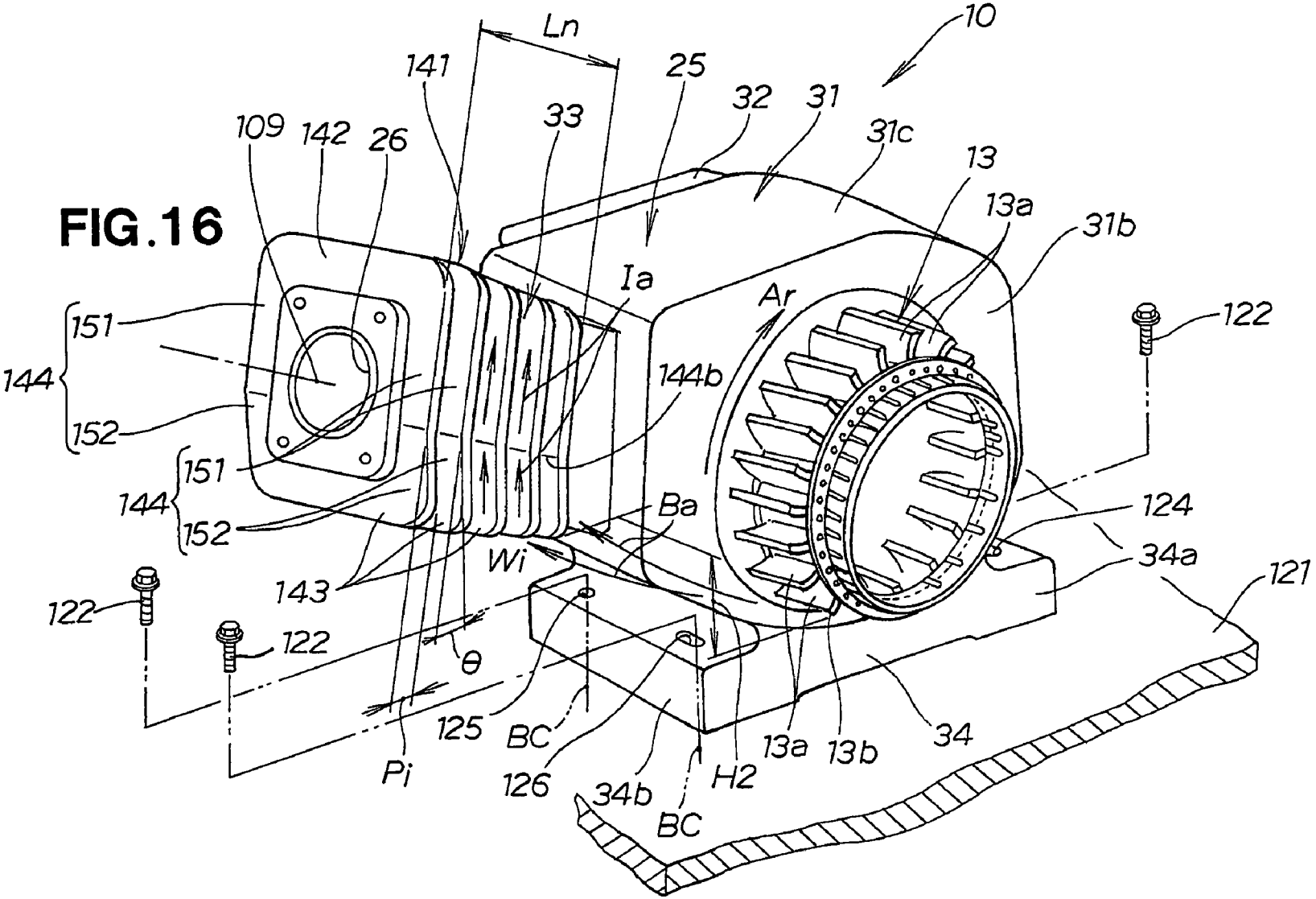
FIG. 16 is a perspective view showing the positional relationship between the cooling fan and the cooling fins shown in FIG. 2.

Specifically, the base 34 has first and second mounting holes 123, 124 at the left end 34*a*, and also has third and fourth mounting holes 125, 126 (the fourth mounting hole 126 is shown in FIG. 16) at the right end 34*b*. These four mounting holes 123 to 126 are aligned vertically (in the vertical direction) in the base 34. The first and third mounting holes 123, 125 are circular. The second and fourth mounting holes 124, 126 are slot-shaped. The base 34 can be attached to the mounting stand 121 by a plurality of bolts 122 that are inserted through each of the four mounting holes 123 to 126.

As shown in FIG. 14, the crank chamber 31*d* of the crank case 31 is a space enclosed by the first side 31*b* (back wall 31*b*), a peripheral wall 31*c*, and the flat plate-shaped base 34. The cylinder block 33 is integrally formed on the right side of the peripheral wall 31*c*. Furthermore, the cylinder block 33 has a plurality of cooling fins 141 formed integrally around the entire outer peripheral surface 33*a*.

Figure 15:
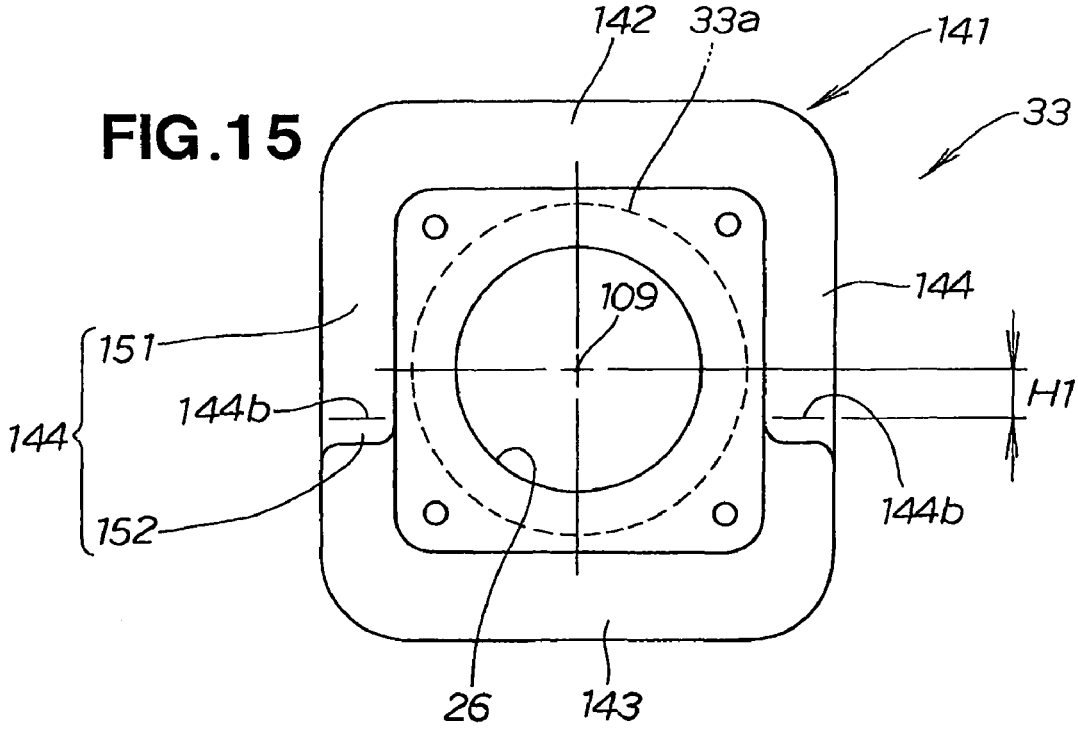
FIG. 15 is a view along the arrow 15 in FIG. 14.

As shown in FIGS. 14 and 15, the cooling fins 141 encircle the outer peripheral surface 33*a* of the cylinder block 33, and have substantially square outline. The cooling fins 141 have a curved shape so that the top halves extend in a direction orthogonal to the cylinder axis 109, and the bottom halves extend vertically. The angle of inclination of the top halves of the cooling fins 141 is the same as the angle of inclination θ of the cylinder axis 109. The cooling fins 141 are each composed of mutually connected top fin 142, bottom fin 143, and pair of left and right lateral fins 144; 144.

As shown in FIGS. 14 through 16, the top fins 142 extend upward from the outer peripheral surface 33*a* of the cylinder block 33, so as to be orthogonal to the cylinder axis 109. The bottom fins 143 extend vertically downward from the outer peripheral surface 33*a*. The lateral fins 144 are curved and comprise slanted fins 151 at the top half and vertical fins 152 at the bottom half.

As shown in FIG. 14, the slanted fins 151 are the portions of the lateral fins 144 that extend from the top ends 144*a* to the curved parts 144*b*. The slanted fins 151 are formed so as to be orthogonal to the cylinder axis 109. Accordingly, the slanted fins 151 are formed at an incline to the vertical direction.

The vertical fins 152 are the portions of the lateral fins 144 that extend from the curved parts 144*b* to the bottom ends 144*c*. The vertical fins 152 are bent towards the vertical direction at the curved parts 144*b*. Therefore, the vertical fins 152 are formed so as to be oriented in the same direction as the opening direction of the four mounting holes 123 to 126 in the base 34. Specifically, the vertical fins 152 are formed parallel to the orientation of the mounting holes 123 to 126.

Thus, the bottom fins 143 and the vertical fins 152 are formed so as to be parallel to the bore center BC of the mounting holes 123 to 126.

The curved parts 144*b* are positioned below the cylinder axis 109 at a distance of H1 (see FIG. 13).

As shown in FIG. 16, the bottom halves of the cooling fins 141, i.e., the bottom fins 143 and the vertical fins 152, are oriented vertically, and the surfaces of the fins are thus disposed closer to the crank case 31 by the corresponding amount. Therefore, the bottom halves of the cooling fins 141 can be slanted towards the cooling fan 13.

As is made clear from the above description, the top halves of the cooling fins 141, i.e., the "counter-base halves" on the side opposite from the base 34 relative to the cylinder axis 109, are composed of the top fins 142 and the slanted fins 151. The bottom halves of the cooling fins 141, i.e., the "base-side halves" disposed closer to the base 34 in relation to the cylinder axis 109, are composed of the bottom fins 143 and the vertical fins 152. The bottom ends of the counter-base halves and the top ends of the base-side halves are linked via the curved parts 144*b*.

As shown in FIG. 16, the cooling fan 13 has a plurality of blades 13*a* for blowing air. The distal end 13*b* of the bottommost blade 13*a* among the plurality of blades 13*a* (the bottom end 13*b* of the cooling fan 13) is disposed below the plurality of cooling fins 141. Specifically, a distance of H2 separates the bottom end 13*b* of the cooling fan 13 from the bottom end of the bottommost fin 143 among the plurality of bottom fins 143.

The cooling fan 13 is configured so that rotation in the direction of the arrow Ar causes cooling air Wi to move towards the bottom halves of the cooling fins 141 (bottom fins 143 and vertical fins 152) from the bottom ends 13*a* (i.e., in the direction of the arrow Ba). For example, the cooling air Wi is conducted by the fan cover 15 (see FIG. 2) so as to flow in the direction of the arrow Ba. Therefore, the cooling air Wi can be admitted between the plurality of cooling fins 141 from below the plurality of bottom fins 143.

As described above, the bottom fins 143 are made to face the cooling fan 13, and the cooling air Wi blown from the cooling fan 13 can therefore be more smoothly conducted. The cooling air Wi admitted from the bottom fins 143 rises along the plurality of cooling fins 141, as shown by the arrow Ia, comes into extensive contact with the radiating surfaces of the cooling fins 141 and the outer peripheral surface 33*a* of the cylinder block 33 (see FIG. 14), and undergoes heat exchange. Therefore, the plurality of cooling fins 141 and the cylinder block 33 can be adequately cooled by the cooling air Wi.

It is more preferable that the top ends of the base-side halves of the cooling fins 141, i.e., the curved parts 144*b*, be positioned along the cylinder axis 109. The reasons for this are given hereinbelow.

First, to improve the cooling efficiency of the cooling fins 141, it is preferable that the flow speed of the cooling air Wi be increased by allowing the cooling air Wi to flow smoothly between the plurality of lateral fins 144 with minimal resistance. This can be achieved by making the lateral fins 144 totally linear without any curving in the middle. This means that the curved parts 144*b* would be dispensed with, and the lateral fins 144 would be configured solely from the vertical fins 152.

In order to increase the amount of heat radiated by the cylinder block 33 and the cooling fins 141, one possibility is to increase the radiating surface area by increasing the number of cooling fins 141. The radiating surface area can be increased by disposing multiple cooling fins 141 at a narrow pitch Pi along the total limited length Ln of the cylinder block 33. In this case it is beneficial to dispense with the curved parts 144*b* and to configure the lateral fins 144 solely from the slanted fins 151.

However, the restriction on the cooling fins 141 is that the base-side halves must be aligned parallel to the bore center BC of the mounting holes 123 to 126. To improve the flow of cooling air Wi and to arrange multiple cooling fins 141 despite this restriction, it is preferable that the height H1 from the cylinder axis 109 shown in FIG. 13 to the curved parts 144*b* be a minimum value of 0 (zero). If the height H1 equals 0, then the curved parts 144*b* coincide with the cylinder axis 109.

Such measures make it possible for cooling air Wi to be more smoothly conducted upward along the cooling fins 47, and for multiple cooling fins 141 to be arranged. As a result, the effects of cooling the cylinder 26 can be further improved.

Next, the die-casting metal mold for casting the casing 25 of the air-cooled engine 10 will be described with reference to FIGS. 17 through 20A. FIG. 18 shows a view with the movable die 162 from FIG. 17 omitted in order to make the configuration easier to understand.

As shown in FIGS. 17 through 20A, a die-casting metal mold 160 is a metal mold for the die-casting of a casing 25. The mole includes a stationary die 161 for forming the back 25*a* of the casing 25, a movable die 162 for forming the front 25*b* of the casing 25, a top sliding die 163 for forming the top 25*c* of the casing 25, a right-end sliding die 164 for forming the right end 25*d* of the casing 25 and the cylinder 26, a bottom sliding die 165 for forming the bottom 25*e* of the casing 25, and a left-end sliding die 166 for forming the left end 25*f* of the casing 25.

The stationary die 161 comprises a casting surface 161*a* for forming the back 25*a* of the casing 25, and is a metal mold whereby the rearward lateral fins 144 are formed using part 161*b* of the casting surface 161*a*.

The movable die 162 is a metal mold that can be closed (clamped) and opened relative to the stationary die 161 in the direction of the arrow S1. The movable die 162 comprises a casting surface 162*a* for forming the front 25*b* of the casing 25, and is a metal mold whereby the forward lateral fins 144 are formed using part 162*b* of the casting surface 162*a*. The movable die 162 has a gate 168. The gate 168 is a channel for supplying molten metal into a cavity 167 (see FIG. 20A).

The top sliding die 163 is a die that can be closed and opened relative to the stationary die 161 in the direction of the arrow S2. This top sliding die 163 comprises a casting surface 163*a* for forming the top 25*c* of the casing 25, and is a metal mold whereby the top fins 142 are formed using part 163*b* of the casting surface 163*a*.

The right-end sliding die 164 is a die that can be closed and opened relative to the stationary die 161 in the direction of the arrow S3. This right-end sliding die 164 is a metal mold that comprises a core 164*a* for forming the cylinder 26.

The bottom sliding die 165 is a die that can be closed and opened relative to the stationary die 161 in the direction of the arrow S4. This bottom sliding die 165 comprises a casting surface 165*a* for forming the bottom 25*e* of the casing 25, and is a metal mold whereby the base 34 and the bottom fins 143 are using part 165*b* of the casting surface 165*a*. The bottom sliding die 165 also comprises first, second, third, and fourth hole-forming areas 165*c* to 165*f* in the casting surface 165*a*.

The first hole-forming area 165*c* is an area for forming the first mounting hole 123 in the base 25. The second hole-forming area 165*d* is an area for forming the second mounting hole 124 in the base 25. The third hole-forming area 165*e* is an area for forming the third mounting hole 125 in the base 25. The fourth hole-forming area 165*f* is an area for forming the fourth mounting hole 126 (see FIG. 16) in the base 25.

The left-end sliding die 166 is a die that can be closed and opened relative to the stationary die 161 in the direction of the arrow S5. This left-end sliding die 166 comprises a casting surface 166*a* whereby the left end 25*f* of the casing 25 is cast.

Next, the procedure for casting the casing 25 by using the die-casting metal mold 160 will be described with reference to FIGS. 17, 20A, and 20B.

Figure 20A:
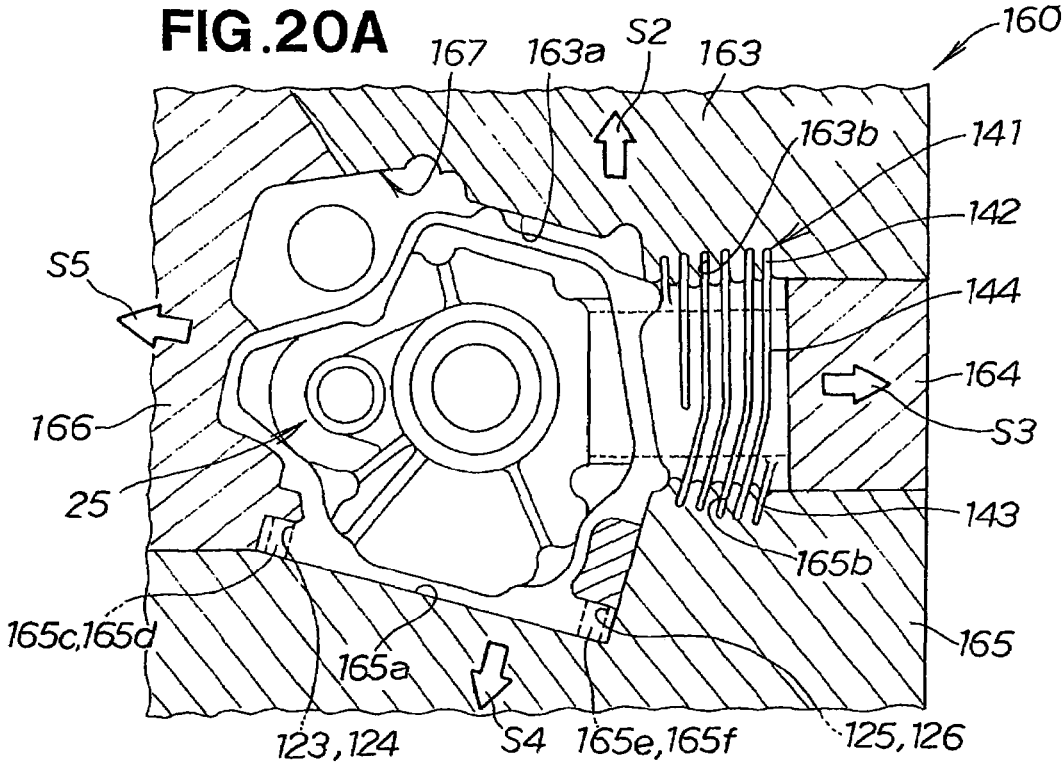
FIGS. 20A and 20B are diagrams describing an example of forming a casing by using the metal mold shown in FIG. 17.

First, the die-casting metal mold 160 is closed, as shown in FIG. 20A.

Figure 17:
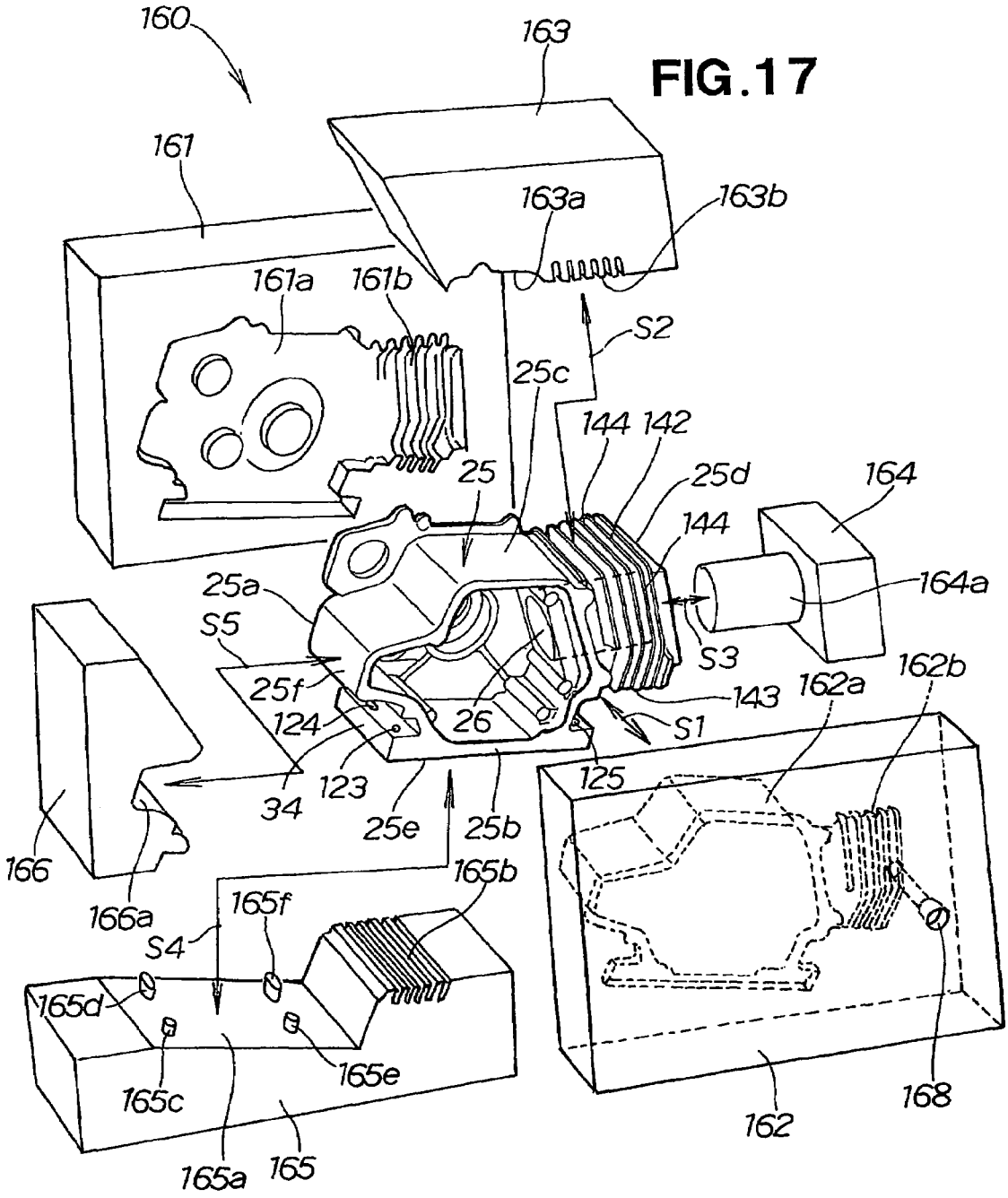
FIG. 17 is an exploded perspective view of the metal mold for casting the casing shown in FIG. 14.
Figure 18:
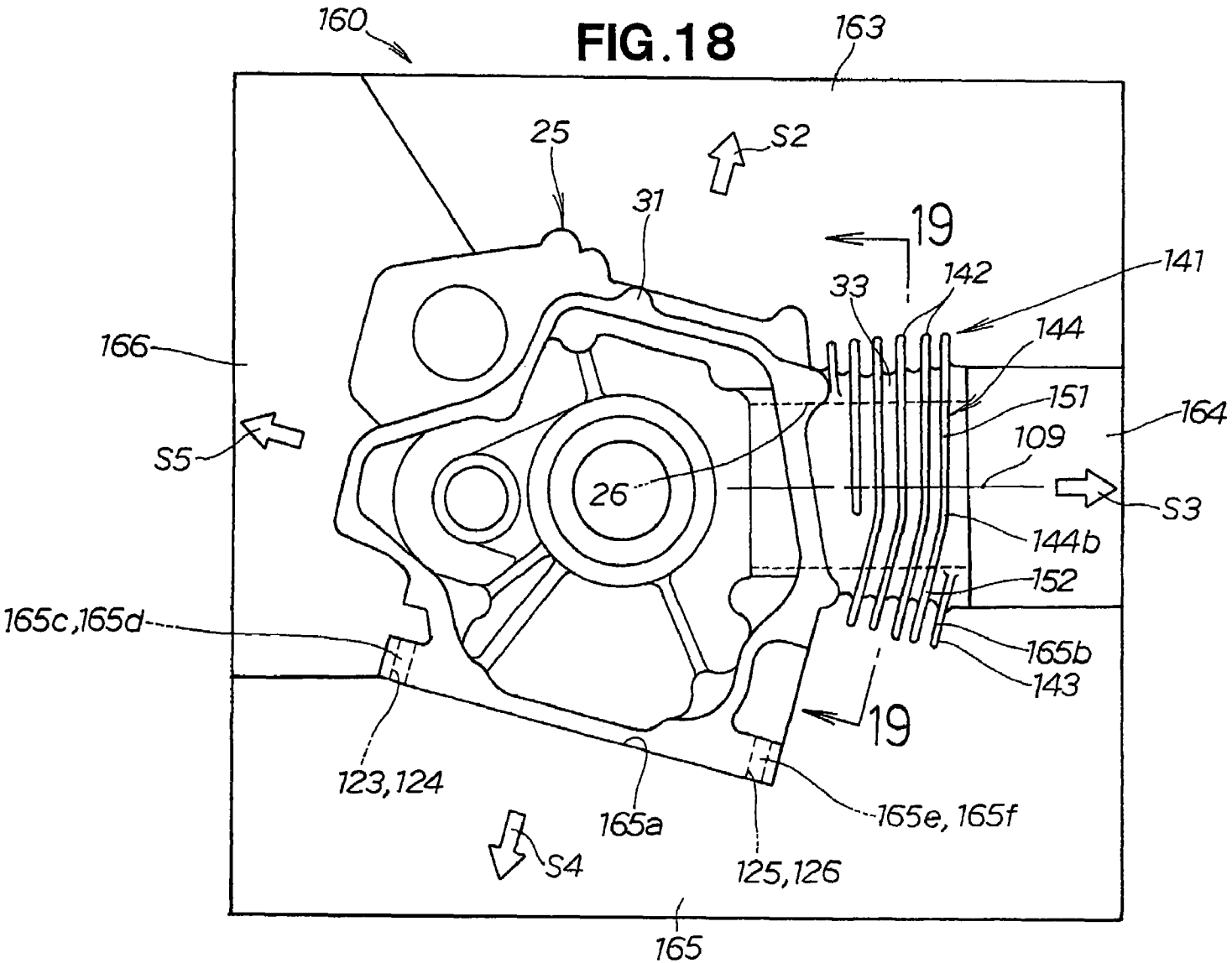
FIG. 18 is an explanatory diagram showing an example in which the metal mold shown in FIG. 17 is closed.
Figure 19:
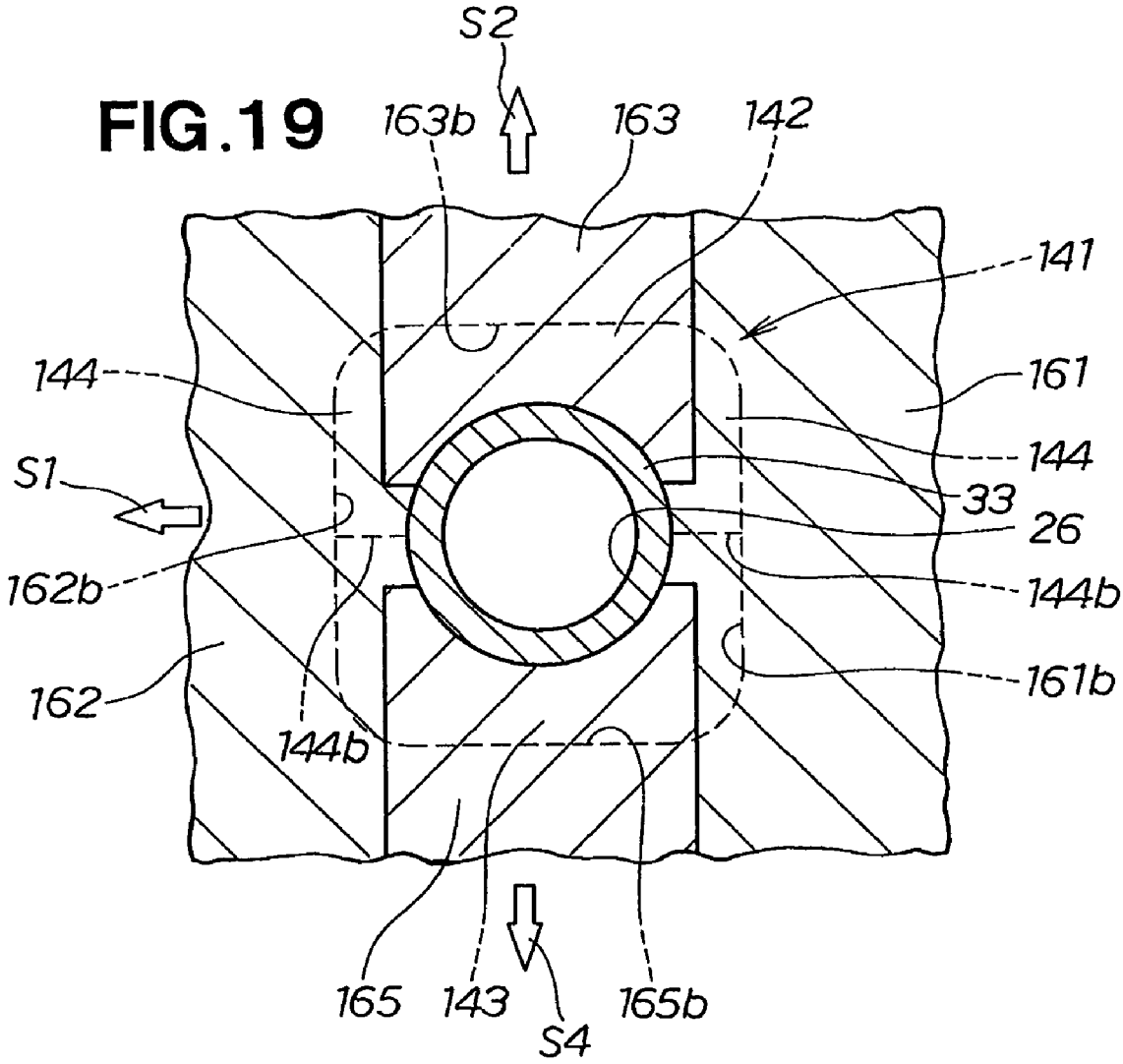
FIG. 19 is a cross-sectional view along the line 19-19 in FIG. 18.

Next, a molten aluminum alloy is fed under high pressure into the cavity 167 through the gate 168 of the movable die 162 (see FIG. 17).

Then, the solidification of the molten metal in the cavity 167 results in the formation of the casing 25 and the auxiliary parts of the casing 25, which are the top fins 142, the bottom fins 143, the lateral fins 144, 144, and the mounting holes 123 to 126.

Specifically, as shown in FIGS. 17 and 20A, part 163*b* of the casting surface 163*a* in the top sliding die 163 is used to cast the top fins 142. Part 165*b* of the casting surface 165*a* in the bottom sliding die 165 is used to cast the bottom fins 143. Part 161*b* of the casting surface 161*a* in the stationary die 161 is used to cast the rearward lateral fins 144. Part 162*b* of the casting surface 162*a* in the movable die 162 is used to cast the forward lateral fins 144. The four hole-forming areas 165*c* to 165*f* of the bottom sliding die 165 are used to cast the four mounting holes 123 to 126.

The die-casting metal mold 160 is then opened. Specifically, the movable die 162 shown in FIG. 17 is moved in the opening direction S1. Next, the top sliding die 163 and the right-end sliding die 164 are moved in the opening directions S2 and S3. Next, the bottom sliding die 165 and the left-end sliding die 166 are moved in the opening directions S4 and S5.

Figure 20B:
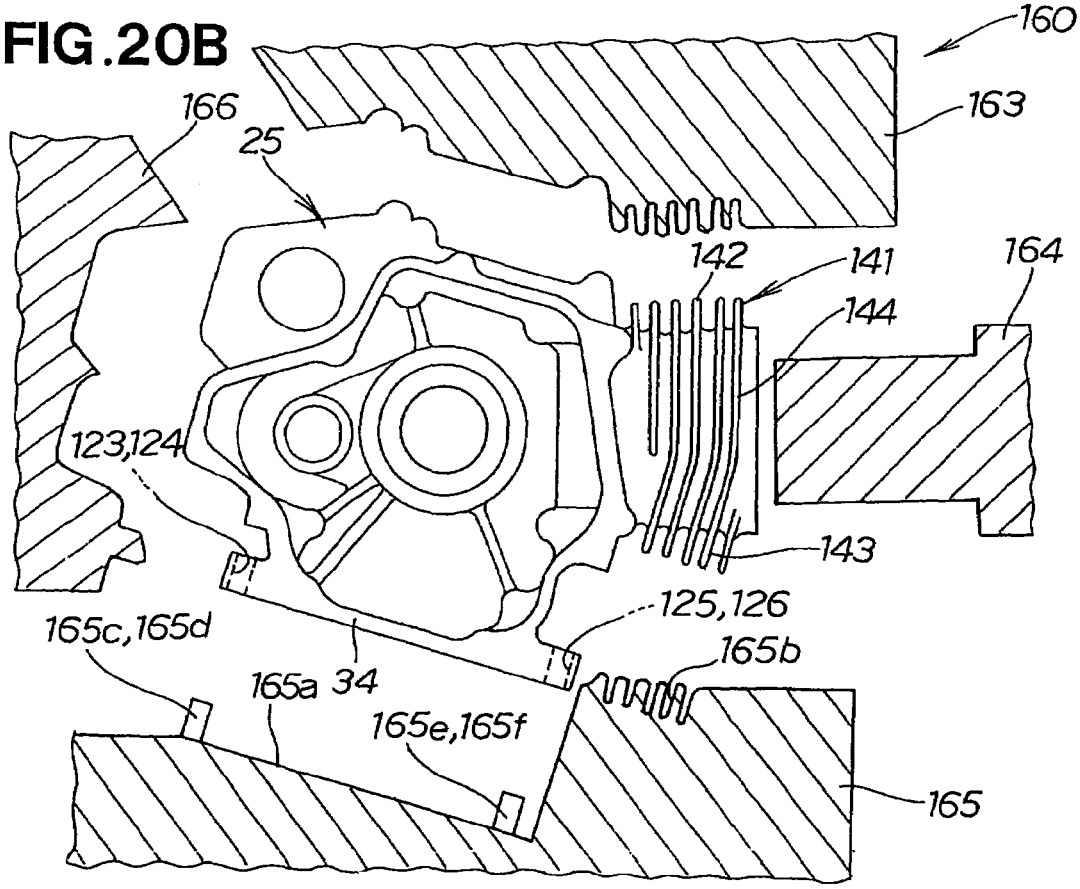

As a result, opening the bottom sliding die 165 makes it possible for the bottom fin casting areas 165*b* to be separated from the bottom fins 143, and the four hole-forming areas 165*c* to 165*f* to be separated from the four mounting holes 123 to 126, as shown in FIG. 20B.

When the casing 25 is being cast using the die-casting metal mold 160 in this manner, the four mounting holes 123 to 126 can be formed in the casing 25 at the same time.

The characteristics of the casing 25 and the die-casting metal mold 160 are summarized as follows.

Of the cooling fins 141, the bottom fins 143 and the vertical fins 152 are oriented in the same vertical direction as the four mounting holes 123 to 126. In order to accommodate this, the bottom sliding die 165 comprises in the casting surface 165*a* the area 165*b* for forming the plurality of bottom fins 143 (the bottom fin casting area 165*b*), and the four hole-forming areas 165*c* to 165*f* for forming the four mounting holes 123 to 126.

The opening direction (the arrow S4) of the bottom sliding die 165 is the same as the orientation of the four mounting holes 123 to 126 and the bottom fins 143, and also the orientation of the vertical fins 152. Therefore, as shown in FIG. 20A, after the molten metal in the cavity 167 solidifies, when the bottom sliding die 165 is opened in the direction of the arrow S4, the bottom fin casting area 165*b* can be separated from the bottom fins 143, and the four hole-forming areas 165*c* to 165*f* can be separated from the four mounting holes 123 to 126. As a result, the four mounting holes 123 to 126 can be formed in the casing 25 when the casing 25 is being cast in the die-casting metal mold 160.

Therefore, there is no need to provide the bottom sliding die 165 with a new sliding die for forming the four mounting holes 123 to 126. Therefore, the cost of preparing the die-casting metal mold 160 can be reduced because the configuration of the bottom sliding die 165 can be simplified.

Aluminum die casting used to die-cast the casing 25 from an aluminum alloy is a casting method in which a molten aluminum alloy is poured at high pressure into a metal mold. The precision with which the casing 25 is cast can be improved by die-casting the casing 25 from an aluminum alloy in this manner.

Moreover, when the casing 25 is being die-cast, counterbore surfaces in contact with the heads of the bolts 122 (see FIG. 16) can be formed, e.g., on the edges of the openings in the four mounting holes 123 to 126. Therefore, the counterbore surfaces do not need to be mechanically worked into the edges of the four mounting holes 123 to 126 after the casing 25 is die-cast, and productivity can be further improved.

Next, the manner in which cooling air Wi flows through the air-cooled engine 10 will be described.

Figure 21:
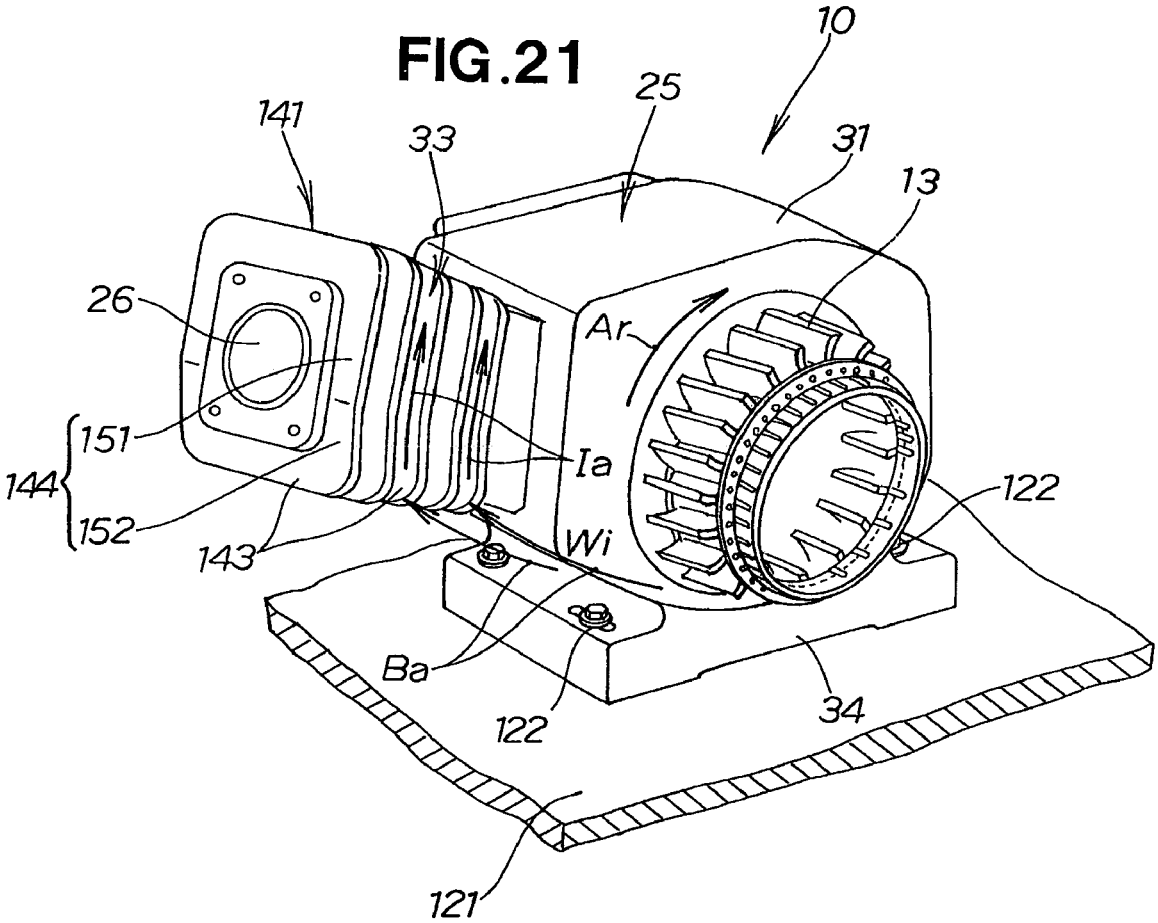
FIG. 21 is a diagram describing an example in which cooling air is conducted by the cooling fins shown in FIG. 16.

As shown in FIG. 21, the cooling fan 13 sends cooling air Wi to the bottom fins 143 (in the direction of the arrow Ba). The bottom fins 143 are oriented towards the cooling fan 13, and the cooling air Wi-sent from the cooling fan 13 can therefore be conducted adequately. The cooling air Wi conducted by the bottom fins 143 rises up along the bottom fins 143, as shown by the arrow Ia, and then flows around the outer peripheral surface 33*a* (see FIG. 15) of the cylinder block 33, whereby the area surrounding the cylinder 26 can be adequately cooled.

In the present invention, an example was described in which the casing 25 was made by the die casting of an aluminum alloy, but the present invention is not limited thereto, and the casing can be die-cast from another material.

Also, an example was described in which two first and second cylinder-cooling ducts 101, 102 were used as the plurality of cylinder-cooling ducts, but the present invention is not limited thereto, and it is also possible to use three or more cylinder-cooling ducts.

An example was also described in which the first cylinder-cooling duct 101 and the head-cooling duct 104 were linked by a pair of communicating channels 105, 105, but the present invention is not limited thereto, and it is also possible to use one or three communicating channels 105, for example.

INDUSTRIAL APPLICABILITY

The present invention can be appropriately applied to an air-cooled engine in which a power transmission mechanism for driving an intake valve and an exhaust valve is provided to the lateral portions of a cylinder head and a cylinder block.

Furthermore, the present invention can be appropriately applied to an air-cooled engine having a tilted cylinder, wherein the base on the bottom of the crank case is provided with mounting holes through which fastening members can be inserted, and cooling fins are provided to the outer periphery of the cylinder block.

The invention claimed is:

1. An air-cooled engine that is cooled by cooling air, the engine comprising:

a cylinder block that comprises a cylinder having a reciprocating piston; and a cylinder head provided to a distal end of the cylinder block;

wherein: the cylinder block comprises at least one cylinder-cooling through-duct capable of transmitting the cooling air, on the periphery of the cylinder;

the cylinder head comprises at least one head-cooling through-duct capable of transmitting the cooling air; and the cylinder-cooling ducts and the head-cooling duct extend in a direction perpendicular to the axial line of the cylinder, and are communicated with each other by means of at least one communicating channel formed on the cylinder block and the cylinder head, wherein the cylinder head comprises a valve chamber for accommodating a camshaft that operates an intake valve and an exhaust valve, and a guide-cooling duct communicated with the head-cooling duct, and the camshaft is driven by a crankshaft via a power transmission mechanism disposed along the cylinder, and wherein top inlets of the cylinder-cooling duct and the head-cooling duct are provided on the side of the power transmission mechanism, and an inlet for the guide-cooling duct is formed in the cylinder head on the side opposite from the power transmission mechanism.

2. The air-cooled engine according to claim 1, wherein the cylinder-cooling ducts are composed of a plurality of ducts, and the one cylinder-cooling duct from among this plurality of cylinder-cooling ducts that is adjacent to the head-cooling duct is communicated with the head-cooling duct via the communicating channels.

3. The air-cooled engine according to claim 1, wherein the communication channels are composed of a pair of separated communication channels.

4. An air-cooled engine that is cooled by cooling air, the engine comprising:

a crank case for accommodating a crankshaft;

a cylinder block that is formed integrally on the crank case and is provided with a cylinder having a reciprocating piston; and a base that is integrally formed on the crank case and can be mounted on arbitrary mating member by a plurality of fastening members; said air-cooled engine characterized in that the base comprises a plurality of mounting holes through which the fastening members can be inserted;

the cylinder block is disposed at an incline in relation to the base and has a plurality of cooling fins formed integrally in the shape of a loop so as to encircle the outer periphery; and the cooling fins have base-side halves that are disposed closer to the base in relation to the axial line of the cylinder and are formed so as to be parallel to the bore center of the mounting holes.

5. The air-cooled engine of claim 4, characterized in that the cylinder block is disposed at a higher location than the base and is inclined upward in relation to the base; and the engine also has a cooling fan for sending cooling air from the crank case to the base-side halves of the cooling fins.

6. The air-cooled engine of claim 5, characterized in that the cooling fan for blowing air has a plurality of blades;

the plurality of blades have a bottommost blade;

the bottommost blade has a distal end; and the distal end is disposed below the cooling fins.

7. The air-cooled engine of claim 5, characterized in that the cooling fins have base-side halves;

the base-side halves have top ends; and the top ends are positioned on the axial line of the cylinder.

* * * * *